US008024110B2

(12) United States Patent
Fushiki et al.

(10) Patent No.: US 8,024,110 B2
(45) Date of Patent: Sep. 20, 2011

(54) METHOD OF ESTIMATION OF TRAFFIC INFORMATION, DEVICE OF ESTIMATION OF TRAFFIC INFORMATION AND CAR NAVIGATION DEVICE

(75) Inventors: Takumi Fushiki, Hitachi (JP); Kenichiro Yamane, Hitachi (JP); Manabu Kato, Hitachimirai (JP); Shinichi Amaya, Higashiyamato (JP)

(73) Assignee: Xanavi Informatics Corporation, Zama-shi (JP)

( * ) Notice: Subject to any disclaimer, the term of this patent is extended or adjusted under 35 U.S.C. 154(b) by 702 days.

(21) Appl. No.: 12/125,565

(22) Filed: May 22, 2008

(65) Prior Publication Data

US 2008/0294331 A1 Nov. 27, 2008

(30) Foreign Application Priority Data

May 22, 2007 (JP) ..... 2007-135115
Jan. 15, 2008 (JP) ..... 2008-006089

(51) Int. Cl.
*G08G 1/00* (2006.01)

(52) U.S. Cl. ..... 701/119; 701/117; 701/209; 701/210; 340/995.13

(58) Field of Classification Search ..... 701/117, 701/119, 200, 72, 201, 208, 209, 210, 211; 340/990, 995.1, 995.13, 995.2
See application file for complete search history.

(56) References Cited

U.S. PATENT DOCUMENTS 6,128,571 A * 10/2000 Ito et al. ..... 701/201
6,222,836 B1 4/2001 Sekiyama et al.
2002/0103597 A1* 8/2002 Takayama et al. ..... 701/200
2003/0176966 A1* 9/2003 Yamashita et al. ..... 701/208
2005/0093720 A1 5/2005 Yamane et al.
2005/0140524 A1 6/2005 Kato et al.
2005/0141428 A1 6/2005 Ishikawa
2005/0206534 A1 9/2005 Yamane et al.
2005/0231394 A1 10/2005 Machii et al.
2006/0025925 A1 2/2006 Fushiki et al.
(Continued)

FOREIGN PATENT DOCUMENTS

DE 198 15 141 C2 11/1998
(Continued)

OTHER PUBLICATIONS

German Office Action dated Mar. 25, 2010 with English translation (eleven (11) pages).

*Primary Examiner* — Gertrude Arthur Jeanglaud
(74) *Attorney, Agent, or Firm* — Crowell & Moring LLP

(57) ABSTRACT

There is provided a method and a device for accurately estimating traffic information of a link having no traffic information even if different types of roads are mixed. The device finds a parameter characterizing a damping curve of a quantity of change of relative speed based on stored traffic information for links on a city center side on a minimum-time cost route connecting the city center and suburbs, finds a quantity of change of relative speed of the link having no observed traffic information and estimates its traffic information based on the damping curve. The device also calculates a ratio of quantities of change of relative speed of two links whose road types change as a speed change similarity ratio and estimates traffic information of the link of a second road type from known traffic information of the link of a first road type by using that ratio.

6 Claims, 20 Drawing Sheets

U.S. PATENT DOCUMENTS

| | | | |
|---|---|---|---|
| 2006/0206256 | A1 | 9/2006 | Kumagai et al. |

FOREIGN PATENT DOCUMENTS

| | | | |
|---|---|---|---|
| DE | 199 35 769 | A1 | 2/2001 |
| EP | 1 061 491 | A1 | 12/2000 |
| JP | 10-103970 | A | 4/1998 |
| JP | 10-283591 | A | 10/1998 |
| JP | 10-332401 | A | 12/1998 |
| JP | 2004-108846 | A | 4/2004 |
| JP | 2005-114546 | A | 4/2005 |
| JP | 2005-122461 | A | 5/2005 |
| JP | 2005-147708 | A | 6/2005 |
| JP | 2005-241313 | A | 9/2005 |
| JP | 2005-241519 | A | 9/2005 |
| JP | 2006-39978 | A | 2/2006 |
| JP | 2006-251941 | A | 9/2006 |
| JP | 2007-115272 | A | 5/2007 |
| JP | 2008-83908 | A | 4/2008 |

* cited by examiner (QUANTITY OF CHANGE OF RELATIVE SPEED)

$$S = \frac{1}{N}\sum_{i=1}^{N}\left(1 - \frac{v_i}{v_{ref}}\right) \qquad \text{Eq. 1}$$

FIG.5A

101 ROAD NETWORK INFORMATION STORING SECTION

| LINK NUMBER |
| --- |
| NODE NUMBER OF STARTING POINT |
| NODE NUMBER OF ENDING POINT |
| LINK LENGTH |
| REFERENCE SPEED |
| TYPE OF ROAD |

FIG.5B

102 LINK TRAFFIC INFORMATION STORING SECTION

| LINK NUMBER | |
| --- | --- |
| LINK SPEED CHANGE DATA | $V_1$ |
| | $V_2$ |
| | $V_3$ |
| | ... |
| | $V_N$ |

FIG.6A

103 REFERENCE ROUTE INFORMATION STORING SECTION

| LINK NUMBER |
| --- |
| FLAG WITH/WITHOUT TRAFFIC INFORMATION |
| QUANTITY OF CHANGE OF RELATIVE SPEED |
| FLAG OF DIRECTION OUTBOUND FOR SUBURB |
| LINK NUMBER OF CITY CENTER-SIDE CONNECTION LINK |
| DISTANCE FROM CITY CENTER |
| NUMBER OF DATA OF CITY CENTER-SIDE |
| SPEED CHANGE DAMPING PARAMETER |

FIG.6B

104 SPEED CHANGE SIMILARITY RATIO STORING SECTION

| LINK NUMBER OF CITY CENTER-SIDE LINK |
| --- |
| LINK NUMBER OF SUBURB-SIDE LINK |
| TYPE OF ROAD OF CITY CENTER-SIDE LINK |
| TYPE OF ROAD OF SUBURB-SIDE LINK |
| SPEED CHANGE DAMPING SIMILARITY RATIO |

500 LINK TABLE

FIG.16

600 COMPLEMENTARY INFORMATION TABLE

61

| COMPLEMENTARY OBJECT LINK NUMBER | LK123456 | LK987654 | ··· |
|---|---|---|---|

| | COMPLEMENT ORIGINAL LINK NUMBER | AVERAGE SPEED |
|---|---|---|
| COMPLEMENT ORIGINAL LINK 1 | LK123450 | 12 |
| COMPLEMENT ORIGINAL LINK 2 | LK123455 | 30 |
| COMPLEMENT ORIGINAL LINK 3 | LK089922 | 25 |
| COMPLEMENT ORIGINAL LINK 4 | LK089921 | 11 |
| ⋮ | ⋮ | ⋮ |
| COMPLEMENT ORIGINAL LINK N | LK089987 | 41 |

611 612

METHOD OF ESTIMATION OF TRAFFIC INFORMATION, DEVICE OF ESTIMATION OF TRAFFIC INFORMATION AND CAR NAVIGATION DEVICE

CROSS-REFERENCE TO RELATED APPLICATIONS

This application claims the foreign priority benefit under Title 35, United States Code, §119(a)-(d) of Japanese Patent Application Nos. 2007-135115, filed on May 22, 2007 and 2008-006089, filed on Jan. 15, 2008 in the Japan Patent Office, the disclosures of which are herein incorporated by reference in their entirety.

BACKGROUND OF THE INVENTION

1. Field of the Invention

The present invention relates to a method of estimation of traffic information and a device of estimation of traffic information for estimating traffic information of roads from which no traffic information is being acquired from traffic information of roads from which the traffic information has been acquired and to a car navigation device for calculating a route by using the traffic information estimated by the method of estimation of traffic information or the device of estimation of traffic information.

2. Description of Related Art

In recent years, it has become possible for a car navigation device to guide a route corresponding to a traffic status at a given time or to a pattern of changes of a traffic amount of a day by using real-time traffic information or statistical traffic information acquired by statistically processing the real-time traffic information provided from traffic information providers.

However, the traffic information provided from the traffic information provider is normally that of expressways and trunk roads and many times, no traffic information of arterial roads is given. As a consequence, the traffic information of such arterial roads, e.g., a link travel time, is handled as what does not change throughout a whole year or whole day. In such a case, the car navigation device is unable to calculate a route to be guided such as a route of shortest time accurately corresponding to a traffic status during commute time for example.

It is noted that a road network is supposed to be composed of nodes and links, wherein the node corresponds to a crossroad such as an intersection and the link corresponds to a road connecting two crossroads. In case of an expressway, its entrances, exits and interchanges correspond to the nodes.

The traffic information of such road network includes the link travel time described above, link speed and others for example. The link travel time is a time required for a vehicle to travel a certain link and the link speed is a value acquired by dividing a length of the link (distance) by the link travel time. Because the traffic information is often found by correlating with links in general, it is called specifically as link traffic information in such a case.

JPH10-283591A discloses an exemplary traffic information estimating method for estimating traffic information of a link having no traffic information by taking a weighted mean of traffic information of a link having the traffic information. The traffic information estimating method assumes such that the larger a distance between links and a difference of directions of the links, the smaller the weight is when the weighted mean is taken. That is, traffic information of a link having no traffic information is calculated by relying on a neighboring link closest to own link and a link oriented in the same direction as much as possible among the links having traffic information.

There has been also a technology of specifying and guiding a recommended route based on traffic information by a navigation device that guides the route by calculating routes from a present location to a destination. However, the traffic information is not provided for all roads and is limited only to main roads. Therefore, there has been proposed a technology of a navigation device as described in JP2005-122461A as a technology for complementing also traffic information of roads for which no traffic information nor statistical information is provided based on traffic information and statistic information of neighboring roads.

JP2005-122461A describes the navigation device that complements traffic information of a road for which no traffic information is provided based on traffic information of closely located roads among roads for which the traffic information is provided or on traffic information of roads within a predetermined range.

However, the traffic information estimating method disclosed in JP. H10-283591A does not consider types of roads. Therefore, in case when an expressway is mixed in a road network and when the expressway has traffic information and arterial roads around the expressway have no traffic information, inadequate information will be calculated as traffic information of the arterial roads if the traffic information of the arterial road is estimated from the traffic information of the expressway. It is unable to estimate link speed of arterial roads whose speed limit is 40 km/hr. from link speed of an expressway whose speed limit is 80 km/hr. by the weighted mean described in JP. H10-283591A. Even if it is possible to estimate the link speed, the calculated speed is not accurate. Accordingly, the traffic information estimating method disclosed in JP. H10-283591A cannot be applied to a road network mixed with an expressway.

Moreover, the navigation device as disclosed in JP. 2005-122461A complements the traffic information by averaging the traffic information of the roads closely located in the same route or the roads within the predetermined range, so that it hardly reflects traffic information of a congestion characteristic to a specific intersection where the congestion is presumed.

In view of the problems of the prior art technologies described above, there have been needs for providing a method of estimation of traffic information and a device of estimation of traffic information (referred to also as a "traffic information estimating method" and a "traffic information estimating device", respectively, hereinafter) that allow traffic information of a link having no traffic information to be accurately estimated based on traffic information of a link having the traffic information even for a road network in which an expressway and arterial roads are mixed and for providing a car navigation device that calculates a route by the traffic information estimated by using the traffic information estimating method or the traffic information estimating device.

There has been also a need for providing a technology of a car navigation device for accurately complementing traffic information for roads for which no traffic information is provided.

SUMMARY OF THE INVENTION

Accordingly, there is provided a traffic information estimating method of a traffic information estimating device having at least a CPU (Central Processing Unit) for arithmetically processing data, a road network information storage section for storing connection data of links composing a road network and types of roads, a link traffic information storage section for storing observed traffic information of part of links composing the road network and for storing estimated traffic information of the links other than the part of the links. The CPU executes steps of calculating a quantity of change of relative speed that is a quantity of change of link speed from a reference speed as data indicating a degree of congestion of the link based on traffic information stored in the link traffic information storage section, calculating a damping parameter that characterizes a damping curve along which the calculated quantity of change of relative speed damps in accordance with a distance from a city center along a route from the city center to a suburb or from the suburb to the city center of the road network, calculating a ratio of quantities of change of relative speed of two forward and following links whose road types change along the route of the road network bound for the suburb from the city center or from the suburb to the city center as a speed change similarity ratio, estimating traffic information of a target link for which no observed traffic information is stored in the link traffic information storage section by using the traffic information stored in the link traffic information storage section for the link on the city center side on the route of the road network bound from the city center to the suburb or from the suburb to the city center, the damping parameter calculated for the target link in the damping parameter calculating step and the speed change similarity ratio calculated for the target link in the speed change similarity ratio calculating step, and storing the estimated traffic information to the link traffic information storage section as the traffic information of the target link.

That is, in case when the target link has no observed information in the link traffic information storage section, the invention is capable of estimating the quantity of change of relative speed of the target link and the traffic information thereof based on the damping curve by finding the parameter (damping parameter) characterizing the damping curve based on traffic information (observed traffic information or estimated traffic information) stored in the link traffic information storage section for the link on the city center side on the route connecting the city center and the suburb. Still more, because the speed change similarity ratio calculating section calculates the ratio of the quantities of change of relative speed of the two links whose road types change on the minimum-time cost route as the speed change similarity ratio, it becomes possible to correlate traffic information of roads whose road types differ. Accordingly, it is possible to accurately estimate traffic information even if roads of different types are mixed in an intended road network.

There is also provided a traffic information estimating device for estimating traffic information of a link composing a road network, including a road network information storage section for storing connection data of links composing the road network and types of roads, a link traffic information storage section for storing observed traffic information of part of links composing the road network and for storing estimated traffic information of the links other than the part of links, a quantity of change of relative speed calculating section for calculating a quantity of change of relative speed that is a quantity of change of link speed from a reference speed as data indicating a degree of congestion of that link based on traffic information stored in the link traffic information storage section, a damping parameter calculating section for calculating a damping parameter that characterizes a damping curve along which the calculated quantity of change of relative speed damps in accordance with a distance from a city center along a route from the city center to a suburb or from the suburb to the city center of the road network, a speed change similarity ratio calculating section for calculating a ratio of the quantities of change of relative speed of the two forward and following links whose road types change along the route of the road network bound for the suburb from the city center or from the suburb to the city center as a speed change similarity ratio and a traffic information estimating section for estimating traffic information of a link for which the observed traffic information is not stored in the link traffic information storage section by using the traffic information stored in the link traffic information storage section for the link on the city center side on the route of the road network bound from the city center to the suburb or from the suburb to the city center, the damping parameter calculated for the target link in the damping parameter calculating section and the speed change similarity ratio calculated for the target link in the speed change similarity ratio calculating section, and for storing the estimated traffic information to the link traffic information storage section as traffic information of the link.

Still more, there is provided a navigation device having a traffic information complementing section, including an intersection retrieving section for retrieving an intersection connected with a road to which traffic information is added and a road to which no traffic information is added, a complement originator retrieving section for tracking a road connected to the intersection retrieved by the intersection retrieving section and to which traffic information is added up to a predetermined distance to specify the road within the tracked range as a complement originator of traffic information, a complement object retrieving section for tracking a road connected to the intersection retrieved by the intersection retrieving section and to which no traffic information is added up to a predetermined distance to specify the road within the tracked range as a complement object of traffic information and a traffic information complementing section for complementing traffic information to the complement object specified by the complement object retrieving section based on the traffic information added to the complement originator specified by the complement originator retrieving section.

There is also provided another traffic information estimating method of a navigation device, including steps of retrieving an intersection connected with a road to which traffic information is added and a road to which no traffic information is added, tracking a road connected to the intersection retrieved in the intersection retrieving step and to which traffic information is added up to a predetermined distance to specify the road within the tracked range as a complement originator of traffic information, tracking a road connected to the intersection retrieved in the intersection retrieving step and to which no traffic information is added up to a predetermined distance to specify the road within the tracked range as a complement object of traffic information and complementing traffic information to the complement object specified in the complement object retrieving step based on the traffic information added to the complement originator specified by the complement originator retrieving step.

As described above, the invention provides the traffic information estimating method and the traffic information estimating device that allow traffic information of a link having no traffic information to be accurately estimated based on traffic information of a link having traffic information even in a road network in which an expressway and city roads are mixed. The invention also provides the car navigation device that calculates a route by the traffic information estimated by using the traffic information estimating method or the traffic information estimating device.

BRIEF DESCRIPTION OF DRAWINGS

FIGS. 5A and 5B are tables showing exemplary configuration of road link information and link traffic information;

FIGS. 6A and 6B are tables showing exemplary configuration of information of reference route and information of speed change similarity ratio;

FIG. 16 is a table showing an exemplary configuration of a complementary information table stored in the storage device;

BEST MODE FOR CARRYING OUT THE INVENTION

A preferred embodiment of the invention will be explained in detail below with reference to the drawings.

Figure 1:
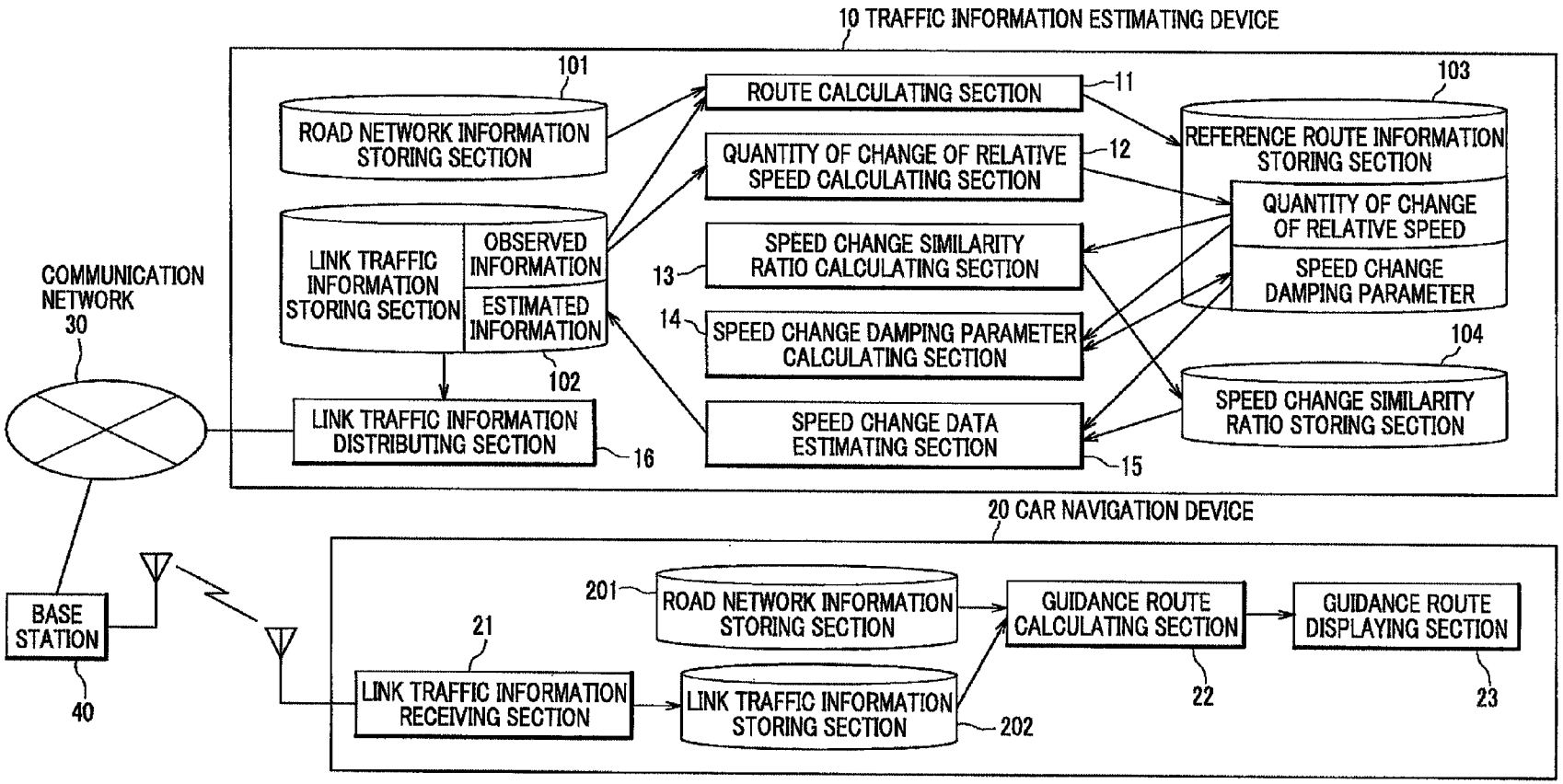
FIG. 1 is a block diagram showing an exemplary configuration of functional blocks of a traffic information estimating device and a car navigation device according to an embodiment of the invention.

FIG. 1 is a block diagram showing an exemplary configuration of functional blocks of a traffic information estimating device and a car navigation device according to an embodiment of the invention. As shown in FIG. 1, the traffic information estimating device 10 includes a functional processing section composed of a route calculating section 11, a quantity of change of relative speed calculating section 12, a speed change similarity calculating section 13 a speed change damping parameter calculating section 14, a speed change data estimating section 15, a link traffic information distributing section 16 and others and an information storage section composed of a road network information storage section 101, a link traffic information storage section 102, a reference route information storage section 103 and a speed change similarity ratio storage section 104 and others.

It is noted that hardware of the traffic information estimating device 10 is composed of a so-called computer containing a CPU (Central Processing Unit) and a storage device. The functional block contained in the functional processing section described above is realized by the CPU that executes predetermined programs stored in the storage device such as a RAM (Random Access Memory). The functional block contained in the information storage section described above is realized by large volume storage devices such as a hard disk unit.

A car navigation device 20 includes a functional processing section composed of a link traffic information receiving section 21, a guidance route calculating section 22, a guidance route displaying section 23 and others and an information storage section composed of a road network information storage section 201, a link traffic information storage section 202 and others. While the car navigation device 20 includes a remote controller for use as an input device, a GPS (Global Positioning System) for positioning the vehicle and others beside those described above, they are not shown here.

Basic functions of the traffic information estimating device 10 in FIG. 1 are to store observed data of link traffic information provided from traffic information providers into the link traffic information storage section 102, to estimate traffic information of a link having no observed data based on the observed data of the link traffic information and road network data stored in the road network information storage section 101 and to store the estimated data into the link traffic information storage section 102.

Note that the method for estimating traffic information of the link having no observed data will be explained later in detail by using the drawings in and after FIG. 2. The observed data of the link traffic information may be actually measured data of traffic information provided from the traffic information providers or may be data acquired by statistically processing the actually measured data including previous actually measured data. At this time, the traffic information estimating device 10 may also carry out this statistic process.

Next, the traffic information estimating device 10 distributes the link traffic information containing the observed data and estimated information from the link traffic information distributing section 16 via a communication network 30 such as Internet and a base station 40 such as a mobile phone.

In response to that, the car navigation device 20 receives the link traffic information distributed from the traffic information estimating device 10 by the link traffic information receiving section 21 and stores the received link traffic information into the link traffic information storage section 202. Then, the car navigation device 20 searches, by means of the guidance route calculating section 22, a guidance route from the present location of the vehicle 20 (hereinafter referred to as "own vehicle location") carrying the car navigation device to a destination set by a user by using the remote controller and others based on the link traffic information stored into the link traffic information storage section 202 and the road network information stored in the road network information storage section 201. The car navigation device 20 then displays the searched guidance route on the guidance route displaying section 23.

It is noted that although not shown in FIG. 1, the traffic information estimating device 10 and the car navigation device 20 normally have drives for reading/writing removable storage media such as a DVD (Digital Versatile Disk) and a USB (Universal Serial Bus) memory. Then, because map data containing the road network information for example takes a large volume, the map data is once written into the DVD and USB memory and is then inputted to the traffic information estimating device 10 and the car navigation device 20 via the DVD and USB memory and their drives.

Although the link traffic information of the traffic information estimating device 10 is assumed to be transmitted to the car navigation device 20 via the communication network 30 in the explanation in FIG. 1, the link traffic information of the traffic information estimating device 10 may be inputted to the car navigation device 20 with off-line operation using the DVD and USB memory when the traffic information estimating device 10 and the car navigation device 20 are provided with the drives for reading/writing the removable storage media.

In succession, a basic idea of a traffic information estimating model of the embodiment will be explained with reference to FIGS. 2 through 4. The present embodiment sets two assumptions in order to estimate traffic information of the link having no traffic information from traffic information of a link having the traffic information, as follows.

The first assumption is that "a degree of congestion of an arterial road neighboring an expressway is similar to a degree of congestion of the expressway." That is, it means that when the expressway is congested, the neighboring arterial road congests as well. Here, the degree of congestion is assumed to be represented by an average traveling speed of vehicles in each link of the road as described later.

According to the first assumption, the degree of congestion of the arterial road may be found, if the degree of congestion of the expressway is known, by multiplying a certain proportional constant to the degree of congestion of the expressway. While it is necessary to decide the proportional constant by some means, how it is decided will be explained later.

The second assumption is that "a degree of congestion of traffics in a city center is larger than a degree of congestion of traffics in suburbs and the further from the city center to the suburbs, the smaller the degree of congestion becomes". A curve that represents this state that the further from the city center to the suburbs, the smaller the degree of congestion becomes is called a damping curve and numerical values representing the characteristic of the damping curve are called damping parameters.

The second assumption means that when a degree of congestion of a certain link and damping parameters of its damping curve are found in a route bound from the city center to the suburb for example, damping parameters and a degree of congestion of a next link connected to that link may be estimated.

Figure 2A:
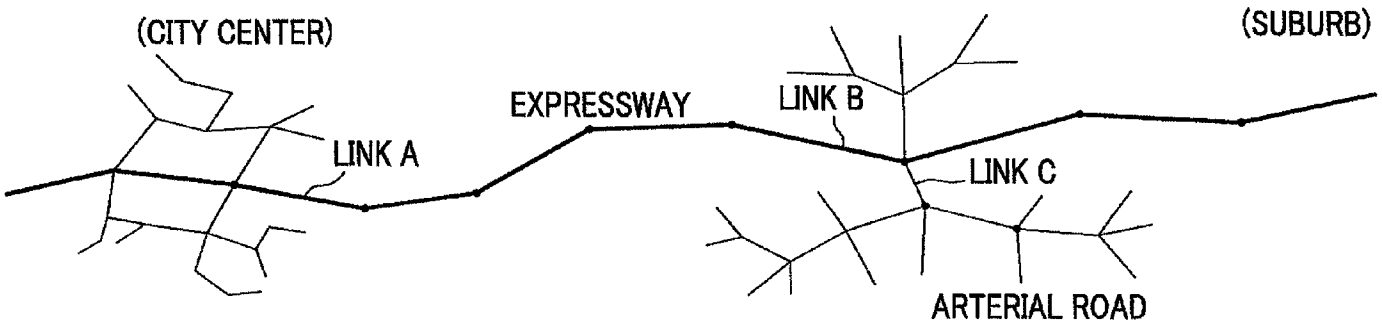
FIGS. 2A through 2D are a diagrammatic view and graphs for explaining an assumption in estimating traffic information according to the embodiment of the invention.
Figure 2B:
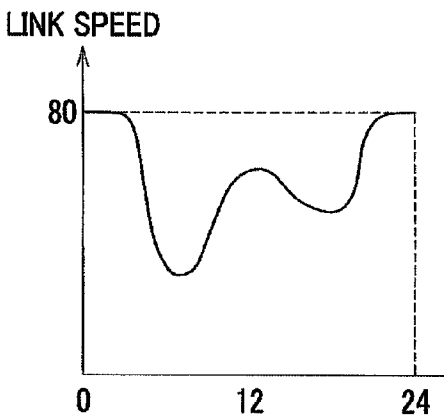
Figure 2C:
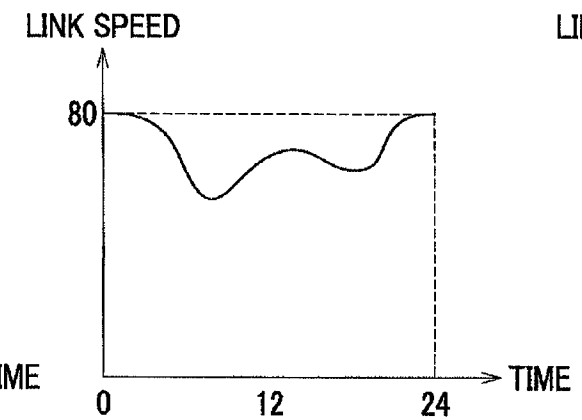
Figure 2D:
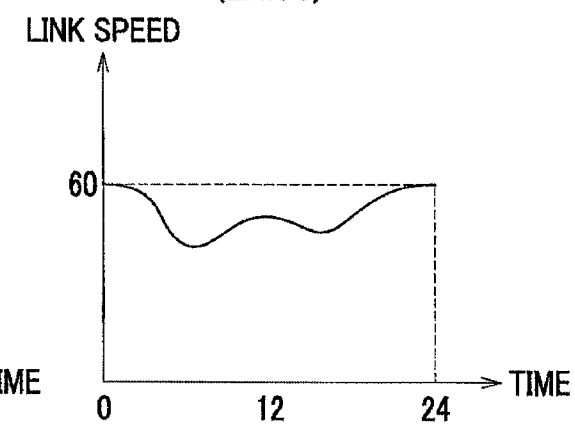

FIG. 2A is a diagrammatic view and FIGS. 3B through 2D are graphs for explaining the assumption in estimating traffic information according to the embodiment described above. FIG. 2A is a diagrammatic view showing an expressway extending from the city center to the suburb and part of arterial roads neighboring the expressway. Here, one link located on the side of the city center of the expressway is called as a link A and another one link located on the side of the suburb is called as a link B. One link of an arterial road connected to the link B is called as a link C.

FIGS. 2B, 2C and 2D are graphs showing daily changes of degrees of congestion of the links A, B and C. Here, the degree of congestion is represented by link speed. When a link is congested, the link speed drops in general. Therefore, due to commuter rushes, peaks of congestion, i.e., valleys of link speed, appear at morning and evening commute time zones in the road extending from the city center to the suburb. Then, because the degree of congestion of the city center is larger than that of the suburb according to the second assumption, the valley of the link speed of the link A on the city center side is deeper than that of the link B on the suburb side as shown in FIGS. 2B and 2C. Furthermore, according to the first assumption, the graph of the changes of the link speed of the link B is similar to the graph of the changes of the link speed of the link C and the link speed of the link C may be correlated with the link speed of the link B by a certain ratio of similarity.

Figure 3:
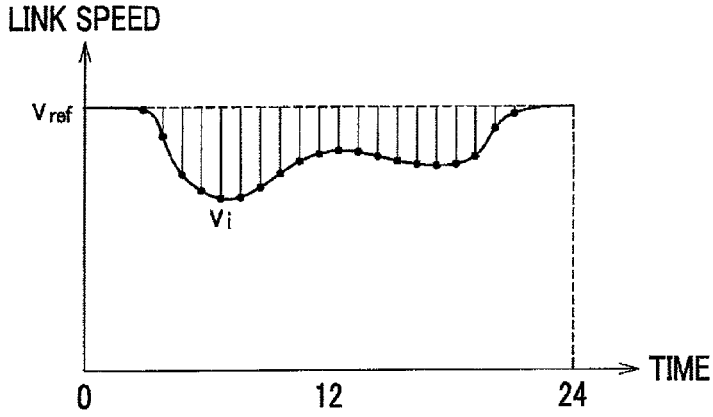
FIG. 3 is a graph illustrating a definition of a quantity of change of relative speed.

FIG. 3 is a graph illustrating a definition of a quantity of change of relative speed. A quantity of change of relative speed S defined by the following equation (1) is adopted in the present embodiment as a parameter representing a degree of congestion of a link. Where, $v_{ref}$ is reference speed of the link, i.e., link speed in midnight and early morning when the link is not congestive at all, and $v_i$ is link speed at i-th time $t_i$ of a day and N is a number of division of a day. For example, when the link speed $v_i$ is acquired in every five minutes, N=288:

$$S = \frac{1}{N}\sum_{i=1}^{N}\left(1 - \frac{v}{v_{ref}}\right) \quad \text{Eq. 1}$$

As it is apparent from the Equation 1, the quantity of change of relative speed S is a value acquired by normalizing the quantity of change of the link speed $v_i$ from the reference speed $v_{ref}$ by the link speed $v_i$ and by averaging it. In other words, the quantity of change of relative speed S may be said to correspond to an average value of depth of the valleys of the curve formed by the link speed $v_i$ in FIG. 3. Accordingly, it means that the larger the quantity of change of relative speed S, the more the link is congested. Therefore, the degree of congestion of the link may be expressed by the quantity of change of relative speed S.

It is noted that instead of the Equation (1), the quantity of change of relative speed S may be defined by a maximum value of the quantities of changes of the link speed $v_i$ from the reference speed $v_{ref}$, i.e., a maximum value of the depth of the valleys of the curve formed by the link speed $v_i$, and others.

Figure 4:
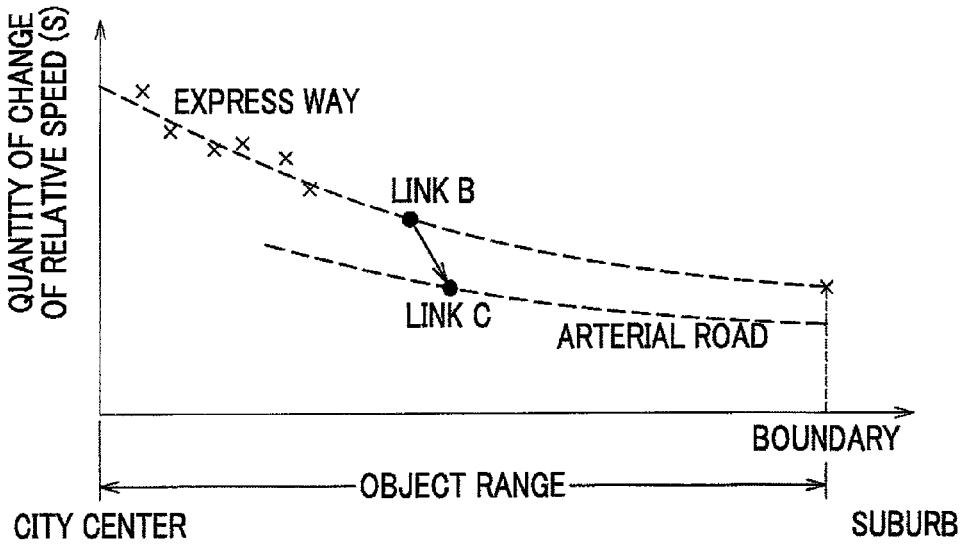
FIG. 4 is a graph showing a state how the quantity of change of relative speed S damps as a vehicle travels from a city center to a suburb by a damping curve.

FIG. 4 is a graph showing a state how the quantity of change of relative speed S damps as a vehicle travels from the city center to the suburb by a damping curve. In FIG. 4, a vertical axis of the graph represents a distance of the way of the link from the city center (referred to simply as "distance" hereinafter) x and a vertical axis represents the quantity of change of relative speed S. Marks (x) denote exemplary plotted values of the quantity of change of relative speed S in the respective links contained in the route from the city center to the suburb. Thus, the quantity of change of relative speed S is normally large in the city center and is small in the suburb. Then, the quantities of changes of relative speed S in the respective links are approximated by a curve of a broken line as shown in FIG. 4 and such curve will be called as the damping curve hereinafter. Such damping curve may be drawn for any route even if it is an expressway or an arterial road. It is noted that a function representing such damping curve may be expressed by any function such as a linear expression, a quadratic expression, a polynomial expression or an exponential expression as long as it is a function that monotonously decreases with respect to the distance x of the way from the city center.

Still more, when the link B in FIG. 2 is directly or substantially directly connected with the link C from each other and when the quantities of changes of relative speed $S_B$ and $S_C$ exist based on observed data of the links B and C, their ratio will be called as a speed change similarity ratio r hereinafter. That is, $r=S_C/S_B$. This speed change similarity ratio r corresponds to a proportional constant referred in the first assumption described above.

Next, configurations of the road network information storage section 101, the link traffic information storage section 102, the reference route information storage section 103 and the speed change similarity ratio storage section 104 will be explained with reference to FIGS. 5 and 6.

FIG. 6A is a table showing an exemplary configuration of the road link information stored in the road network information storage section 101 and FIG. 5B is a table showing an exemplary configuration of the link traffic information stored in the link traffic information storage section 102. It is noted that these road link information and link traffic information are used as input data of a traffic information estimating process explained in FIG. 7 and thereafter.

The road link information stored in the road network information storage section 101 is composed of topological connection information and physical attribute information about links contained in an intended road network. As shown in FIG. 5A, the road link information includes a link number, a starting node number, a terminal node number, a link length, reference speed and a type of road (type such as an expressway and an arterial road). It is noted that node information not shown is stored beside the road link information in the road network information storage section 101. The node information is information containing positional information (latitude and longitude) of nodes contained in the intended road network.

Further, the link traffic information stored in the link traffic information storage section 102 is link speed change data of each link contained in the intended road network. Here, the link speed change data is a set of link speed change data $v_1$, $v_2$, . . . and $v_N$ at each time of a day $t_1$, $t_2$, . . . and $t_N$ as shown in FIG. 5B.

It is noted that the link speed change data ($v_1$, $v_2$, . . . and $v_N$) is assumed to exist only for those links (e.g., links of the expressway and links of part of arterial roads) provided with observed data from the traffic information provider in an initial state. The link speed change data ($v_1$, $v_2$, . . . and $v_N$) of those links for which no observed data is provided will be then estimated by the traffic information estimating process explained in and after FIG. 7.

FIG. 6A is a table showing an exemplary configuration of information of a reference route stored in the reference route information storage section 103 and FIG. 6B is a table showing an exemplary configuration of information of the speed change similarity ratio stored in the speed change similarity ratio storage section 104.

The reference route information stored in the reference route information storage section 103 includes a link number, a flag with/without traffic information, a quantity of change of relative speed, a flag indicating outbound, a link number of a link connected on the city center side, a distance from the city center, a number of datum of the city center side, a speed change damping parameter and others.

It is noted that although the reference route is assumed to be a route acquired when a minimum-time cost route is calculated based on the link length and the reference speed of the respective links from the city center to the suburb or from the suburb to the city center in an explanation below, the reference route is not always necessary to be acquired by calculating a route nor be a minimum-time cost route. For instance, an expressway or a trunk road heading from the city center to the suburb may be defined as a reference route.

Here, the flag with/without traffic information is a flag indicating that the link (specified by the link number) contains observed data of the link speed change data and the quantity of change of relative speed is a value of the quantity of change of relative speed S obtained from the link speed change data based on the Equation (1) described above. It is noted that the quantity of change of relative speed S is calculated for the links having observed data by making reference to the link traffic information storage section 102 and then for the links having no observed data.

Next, the respective data below the flag of direction inbound/outbound for suburb in FIG. 6A are datum acquired in calculating the reference route. That is, the flag of direction inbound/out bout for suburb is a flag indicating that a direction of the route calculation is carried out from the city center to the suburb and the link number of the link connected on the city center side is a link number of the link connected on the city center side of the target link in the acquired reference route. The distance from the city center is a distance of the way from the city center to the target link along the reference route and the number of datum of the city center side is a number of links existing on the city center side along the reference route and having the quantity of change of relative speed S. The speed change damping parameter is a parameter representing characteristics of the damping curve of the quantity of change of relative speed S shown in FIG. 4 and is a coefficient of a linear expression, quadratic expression, polynomial expression, exponential expression or the like.

Next, as shown in FIG. 6B, information of the speed change similarity ratio stored in the speed change similarity ratio storage section 104 includes datum about a boundary of types of roads acquired when the minimum-time cost route is calculated based on the reference speed of the respective links bound for the suburb from the city center or bound for the city center from the suburb and the speed change similarity ratio at that time. Here, the datum about the boundary of the types of roads are a link number of a link on the city center side at the boundary, a link number of a link on the suburb side, a type of road on the city center side link and a type of road of the suburb side link.

By the way, in a case of FIG. 2A, the link number of the link B, the link number of the link C, the type of road (expressway) of the link B, the type of road (arterial road) of the link C and a value of the speed change similarity ratio r between the link B and the link C, i.e., $r=S_C/S_B$ are stored in the speed change similarity ratio storage section 104.

Next, the traffic information estimating process in the traffic information estimating device 10 will be explained in detail by making reference to FIGS. 7 through 11. These traffic information estimating processes are realized by the CPU of the traffic information estimating device 10 that executes a program stored in advance in the storage device of the traffic information estimating device 10.

Figure 7:
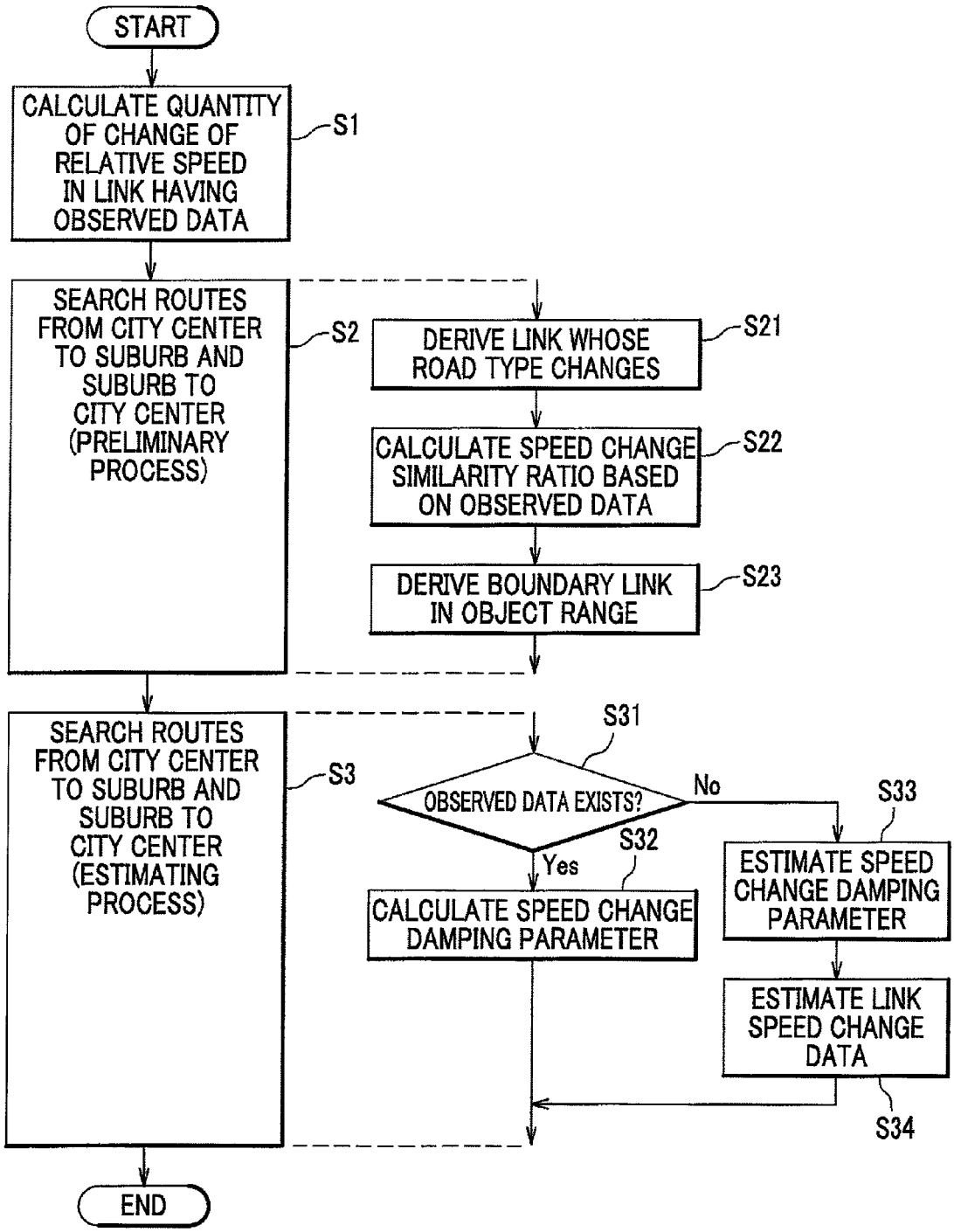
FIG. 7 is a flowchart showing an outline of a traffic information estimating process.

FIG. 7 is a flowchart showing an outline of the traffic information estimating process. As shown in FIG. 7, the CPU of the traffic information estimating device 10 (simply referred to as the CPU hereinafter) executes roughly the following three steps as the traffic information estimating process.

At first, the CPU calculates the quantity of change of relative speed S for a link having observed data of link speed change data (simply referred to as observed data hereinafter) by making the link traffic information storage section 102 as a first process (Step S1) and stores the calculated quantity of change of relative speed S to the reference route information storage section 103.

Next, the CPU performs a route calculation for searching a reference route respectively bound for the suburb from the city center and bound for the city center from the suburb as a second process (preliminary process: Step S2).

That is, the CPU picks up links whose road types change along the reference route acquired during the route calculation (Step S21) and makes reference to the link traffic information storage section 102 to calculate a speed change similarity ratio from the quantities of change of relative speed S of the forward and following links when those links whose road types change have observed data (Step S22). The CPU also picks up a boundary link in an object range of route calculation in the route calculation (Step S23) and stores data such as its link number to a boundary link table (not shown in FIG. 1).

The CPU also performs the route calculation for searching the reference route again bound for the suburb from the city center and bound for the city center from the suburb to estimate link speed change data of a link having no observed data during the process of route calculation as a third process (estimating process: Step S3).

That is, the CPU determines whether or not the link traffic information storage section 102 contains observed data for the respective links along the reference route acquired during the route calculation (Step S31). When there exists observed data (Yes in Step S31), the CPU finds a damping curve of the quantity of change of relative speed S based on the quantity of change of relative speed S of the target link and the links on the reference route acquired up to then and calculates its speed change damping parameter (Step S32). When there exists no observed data (No in Step S31), the CPU estimates a speed change damping parameter of the target link based on the speed change damping parameter of the damping curve of the quantity of change of relative speed S along the reference route acquired up to then (Step S33) and estimates further the link speed change data ($v_1$, $v_2$, . . . and $v_N$) (Step S34).

Subsequently, the preliminary process (Step S2) and the estimating process (Step S3) in FIG. 7 will be explained in detail.

Figure 8:
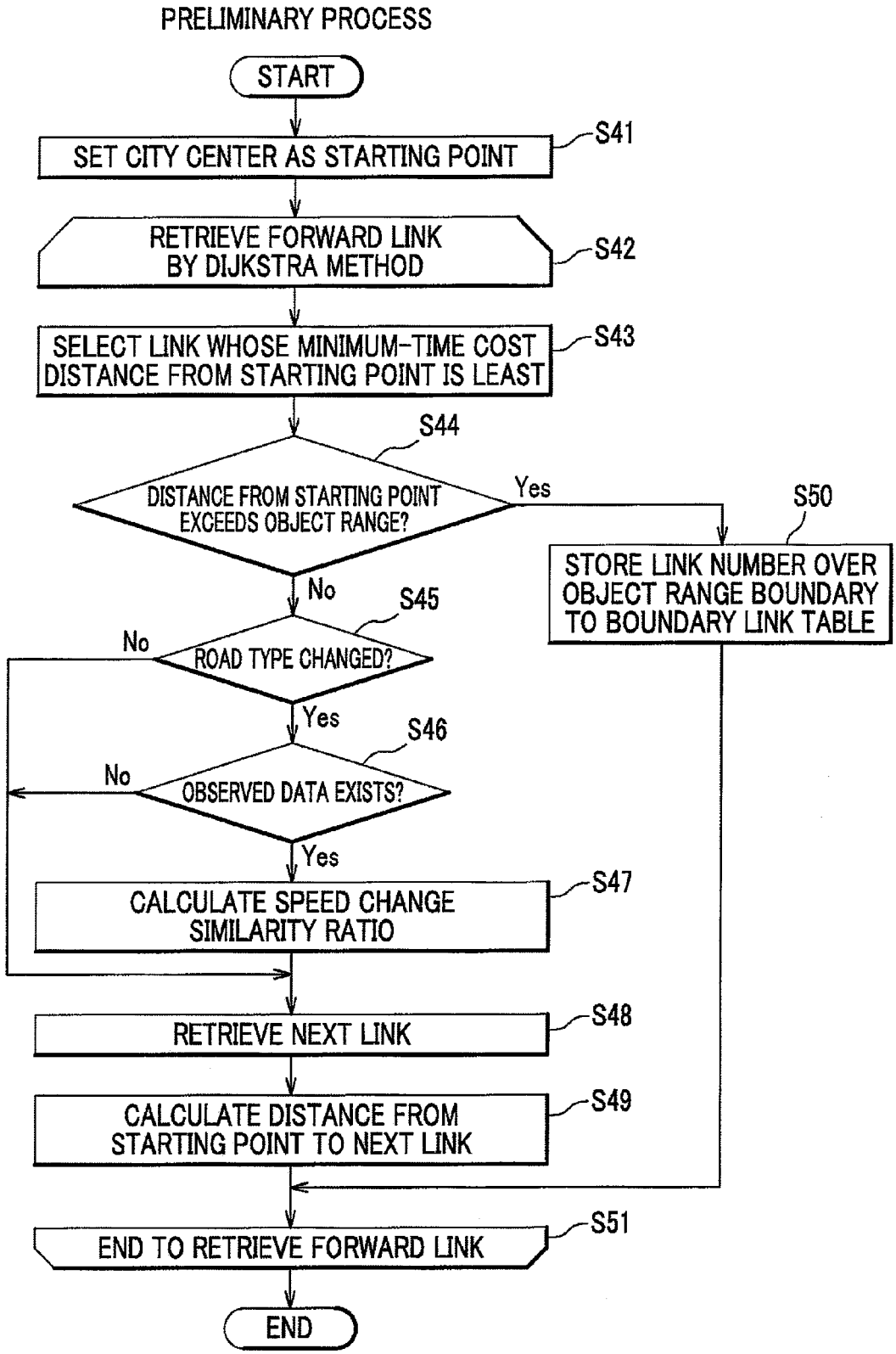
FIG. 8 is a flowchart showing an exemplary detailed processing flow of a preliminary process in the traffic information estimating process.

FIG. 8 is a flowchart showing an exemplary detailed processing flow of the preliminary process (Step S2) in FIG. 7. It is noted that although the route calculation is carried out respectively in the directions from the city center to the suburb and from the suburb to the city center, the processing flow in FIG. 8 is a processing flow when the route calculation is carried in the direction from the city center to the suburb. Because the route calculation in the direction from the suburb to the city center may be carried out in the same manner as described above, the explanation is omitted here.

As shown in FIG. 8, at first the CPU sets the city center as a starting point to search the reference route (Step S41). Assume here that a node of the certain city center is set in advance as the starting point. Next, the CPU performs a forward link retrieval by a method of dijkstra by setting that node as the starting point (Step S42).

It is noted that in the forward link retrieval by means of the method of dijkstra in Step S42, the CPU retrieves the road network information storage section 101 to retrieve a link connected before a terminal node of an outermost peripheral link on a minimum-time cost route extending from the node of the starting point or from the starting point to the outside and defined at least up to then and picks up that link as a result of the retrieval only when the retrieved link is a link that rides on the minimum-time cost route extending further to the outer periphery. Accordingly, it is possible to define a minimum-time cost distance and its minimum-time cost route from the starting point to the terminal point of the link as for the link retrieved and picked up in the forward link retrieval. Then, the CPU stores the link number, the minimum-time cost distance and the minimum-time cost route retrieved and picked up as described above to a forward link information table (not shown in FIG. 1).

Next, the CPU selects a link whose minimum-time cost distance of the link from the starting point is the least among the links contained in the forward link information table (Step S43). Then, the CPU determines whether or not the distance (distance of the way) of the link from the starting point exceeds the object range (Step S44). Here, the object range is an object range of the traffic information estimating process and is decided in advance by the distance of the way from the city center, e.g., an object range within 40 km from the city center.

When the distance of the link from the starting point is not exceeding the object range (No in Step S44), the CPU makes reference to the road network information storage section 101 to determine whether or not the type of road has changed with respect to the target link and to a link connected to a beginning side (city center side) of the target link along the reference route (Step S45). When the types of road of two links have changed (Yes in Step S45), the CPU makes reference to the link traffic information storage section 102 to determine whether or not those two links have observed data of link speed change data (Step S46).

When those two links have the observed data of the link speed change data as the result of the determination (Yes in Step S46), the CPU takes the quantity of change of relative speed S of those two links out of the reference route information storage section 103 and calculates the speed change similarity ratio r based on the quantity of change of relative speed S of those two links (Step S47).

When the types of roads of those two links have not changed in the determination in Step S45 (No in Step S45) or when there exists no observed data of the link speed change data of those two links in the determination of Step S45 (No in Step S46), the CPU skips the process in Step S47.

Next, the CPU refers to the road network information storage section 101 to retrieve a link whose starting node information is the terminal node information of the target link as a next link (Step S48) and calculates a distance from the starting point to the next link acquired by the retrieval (Step S49).

When the distance from the starting point of the target link exceeds the predetermined object range in the determination in Step S44 (Yes in Step S44), the CPU stores the link number of the target link to the boundary link table stored in the storage device (Step S50).

When the CPU finishes the process in Step S49 or in Step S50, i.e., when the CPU finishes the process about the link selected in Step S43, the CPU deletes the data of that link from the forward link information table. Meanwhile, the CPU determines whether or not the link retrieved and acquired in Step S48 is on the course of the minimum-time route extending to the outer periphery and stores a link number, a minimum-time cost distance and a minimum-time cost route of that link in the forward link information table if the link rides on the minimum-time cost route.

It is noted that the CPU determines whether the next link is on the course of the minimum-time cost route by the following two conditions. That is, (1) the CPU determines that the next link is on the course of the minimum-time cost route when the terminal node of the next link is different from terminal nodes of all links stored in the forward link information table; and (2) when the terminal node of the next link is the same with a terminal node of anyone of the links stored in the forward link information table, the CPU compares a minimum-time cost distance to the next link with a minimum-time cost distance to a link whose terminal node is the same with that of the next link and determines that the next link is on the course of the minimum-time cost route when the minimum-time cost distance to the next link is shorter. When the CPU determines that the next link is on the course of the minimum-time cost route from the condition of (2), it deletes data of the link whose terminal node is the same with that of the next link stored in the forward link information table until then.

Next, the CPU determines whether or not data of the link retrieved in the forward link retrieval remains by making reference to the forward link information table. When the data of the link remains, the CPU returns to Step S43 and when no data of the link remains, the CPU finishes the forward link retrieval (Step S51).

Figure 9:
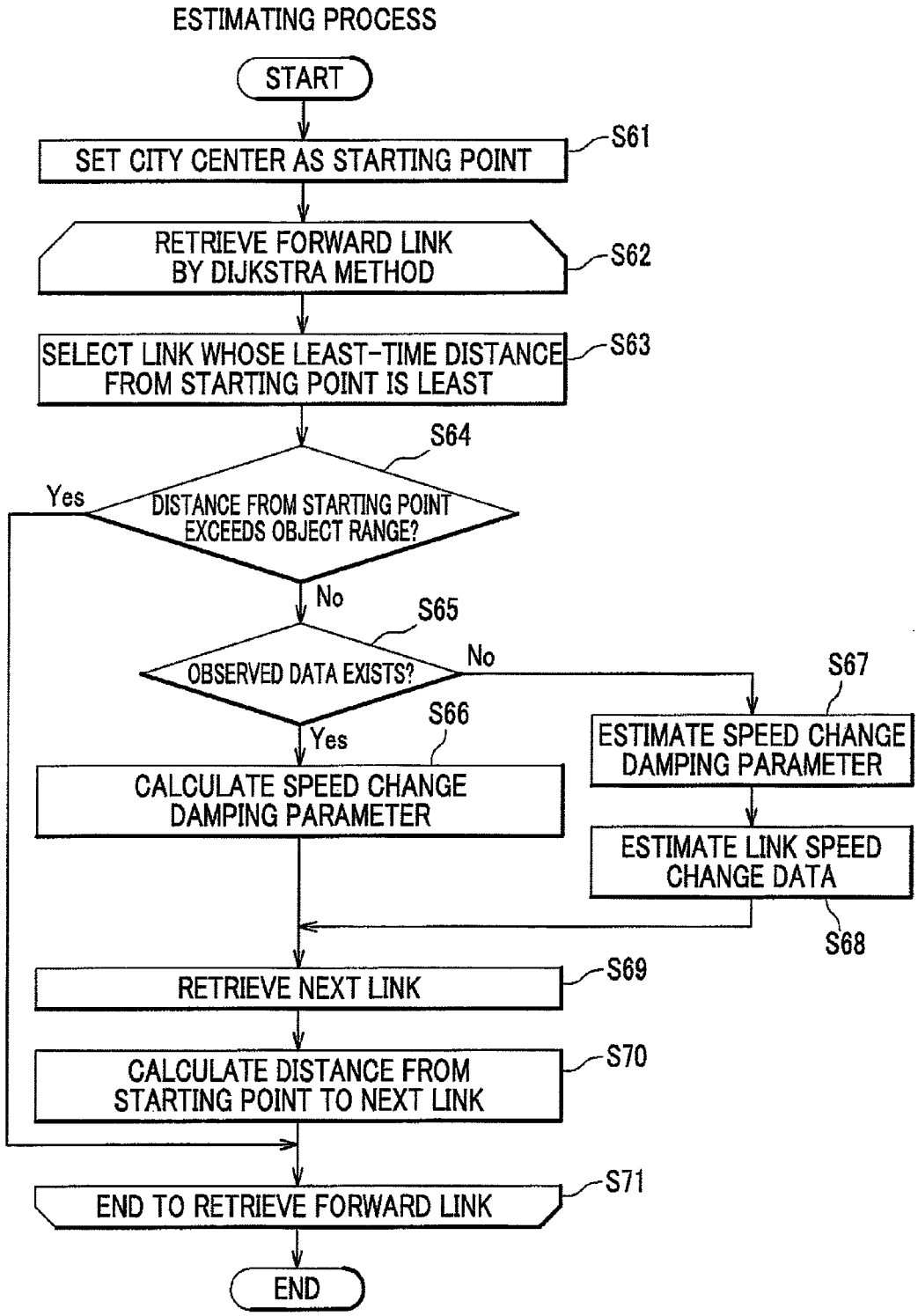
FIG. 9 is a flowchart showing an exemplary detailed processing flow of the traffic information estimating process.

FIG. 9 is a flowchart showing an exemplary detailed processing flow of the traffic information estimating process (Step S3) in FIG. 7. It is noted that the route calculation has been carried out for the directions from the city center to the suburb and from the suburb to the city center in Step S3 in FIG. 7, the processing flow in FIG. 9 is a processing flow when the route calculation is carried out for the direction from the city center to the suburb. The route calculation for the direction from the suburb to the city center may be carried out also in the same manner, so that its explanation will be omitted here.

As shown in FIG. 9, the CPU sets the city center as a starting point to search a reference route at first (Step S61). Here, assume that a certain node of the city center is set as the starting point in advance. Next, from that node as the starting point, the CPU carries out the forward link retrieval by the method of dijkstra (Step S62). Processing contents of the forward link retrieval are the same with the forward link retrieval in Step S42 in FIG. 8, so that the CPU stores a link number, a minimum-time cost distance and a minimum-time cost route from the starting point of a link retrieved and selected by the forward link retrieval to the forward link information table provided in the storage device in the same manner with what described above.

Next, the CPU selects a link whose minimum-time cost distance from the starting point is least among links contained in the forward link information table (Step S63). Then, the CPU determines whether or not the distance (distance of a way) from the starting point of the link exceeds an object range (Step S64). Here, the object range is that of the traffic information estimating process and is assumed to be set in advance like the distance of the way from the city center set in the same manner in Step S44 in FIG. 8 like a range within 40 km from the city center for example.

When the distance of the link from the starting point is not exceeding that object range (No in Step S64), the CPU determines whether observed data exists in the target link by making reference to the link traffic information storage section 102 (Step S65). When there exists observed data (Yes in Step S65), the CPU calculates a speed change damping parameter by finding a damping curve of a quantity of change of relative speed S based on a quantity of change of relative speed S of the target link and a quantity of change of relative speed S of a link connected to the starting point side (city center side) of the target link along the reference route to the target link (Step S66). It is noted that a processing flow for calculating the speed change damping parameter will be explained later in detail with reference to FIG. 10.

When there exists no observed data (No in Step S65), the CPU estimates a speed change damping parameter of the target link based on the speed change damping parameter of the damping curve of the quantity of change of relative speed S along the reference route acquired until arriving at the target link (Step S67) and also estimates link speed change data ($v_1$, $v_2$, . . . and $v_N$) of the target link (Step S68). It is noted that a processing flow for estimating the link speed change data will be explained later in detail by making reference to FIG. 11.

In succession to Step S66 or Step S68, the CPU retrieves a link whose starting node number is a terminal node number of the target link as a next link by making reference to the road network information storage section 101 (Step S69) and also calculates a distance from the starting point to the next link acquired by the retrieval (Step S70).

Next, when the distance of the target link from the starting point exceeds the object range set in advance in the determination in Step S64 (Yes in Step S64) or the processes up to Step S70 end, the CPU deletes data of that link from the forward link information table because the processes of the link selected in Step S63 end. Meanwhile, the CPU determines whether or not the next link acquired by retrieving in Step S69 is on the course of the minimum-time cost route extending to the outer periphery. For the link on the course of the minimum-time cost route, the CPU stores its link number, minimum-time cost distance and minimum-time cost route in the forward link information table.

It is noted that the determination whether or not the next link is on the course of the minimum-time cost route is made by two conditions in the same manner with the case of the preliminary process in FIG. 8. The two conditions are the same with the case of the preliminary process in FIG. 8, so that its explanation will be omitted here.

Next, the CPU determines whether or not data of the link retrieved in the forward link retrieval remains by making reference to the forward link information table. The CPU returns to Step S63 when the data of the link remains and ends the forward link retrieval when no data of the link remains (Step S71).

Figure 10:
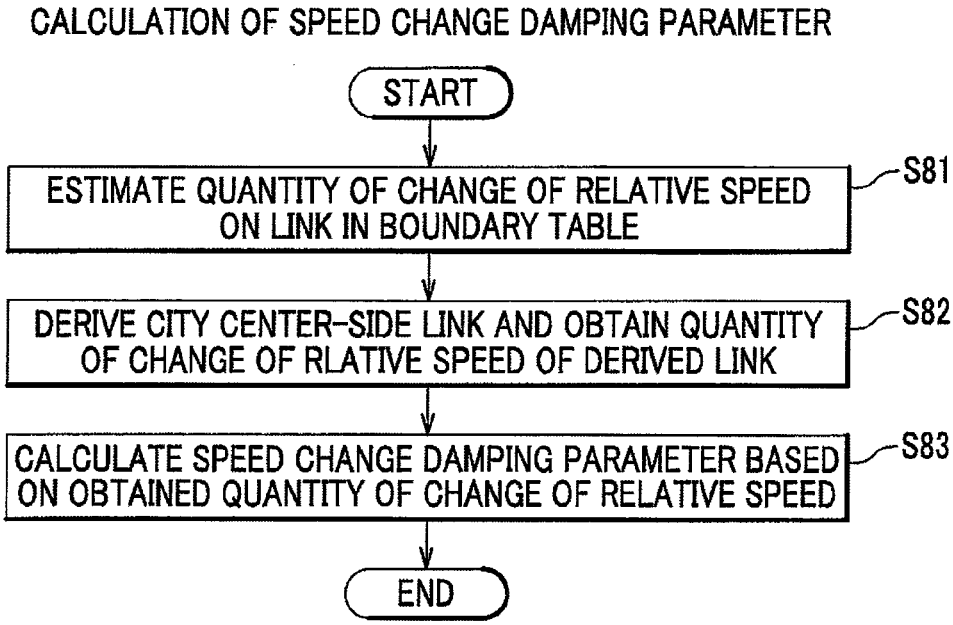
FIG. 10 is a flowchart showing an exemplary detailed processing flow of a speed change damping parameter calculating process in the traffic information estimating process.

FIG. 10 is a flowchart showing an exemplary detailed processing flow of the process (Step S66) for calculating the speed change damping parameter in FIG. 9.

As shown in FIG. 10, the CPU estimates a quantity of change of relative speed S of a boundary link when the minimum-time cost route extending from the target link to the suburb exceeds the object range (Step S81). That is, the CPU estimates a value of a right edge on the suburb side of the damping curve of the quantity of change of relative speed S in FIG. 4, i.e., a minimum value of the quantity of change of relative speed S.

At this moment of estimating the minimum value, the CPU has found the boundary link in Step S50 in the preliminary process in FIG. 8 and has found a quantity of change of relative speed S of the link having link speed change data. Then, the CPU finds a quantity of change of relative speed S of a boundary link having the same road type by making reference to the boundary link table, the reference route information storage section 103 and others and estimates a quantity of change of relative speed $S_{min}$ in the boundary link when the minimum-time cost route extending from the target link to the suburb exceeds the object range based on the quantity of change of relative speed S of the boundary link.

Then, the CPU calculates the quantity of change of relative speed $S_{min}$ in the boundary link based on the following Equation 2:

$$S_{min} = \frac{\sum_{k=1}^{M} \frac{S_k}{d_k}}{\sum_{k=1}^{M} \frac{1}{d_k}} \quad \text{Eq. 2}$$

In the Equation 2, $S_k$ is a quantity of change of relative speed of a k-th boundary link having the same road type with the target link and having the quantity of change of relative speed S, $d_k$ is a distance (straight distance) between the target link and the k-th boundary link and M is a number of boundary links having the same road type with the target link and having the quantity of change of relative speed S.

It is noted that the Equation 2 shows that the quantity of change of relative speed S in the boundary link when the minimum-time cost route extending from the target link to the suburb exceeds the object range is a mean value acquired by weighting an inverse number of a distance between the target link and each boundary link to the quantity of change of relative speed S of the boundary link calculated by observed data.

Returning to FIG. 10, the CPU makes reference to the reference route information storage section 103 to pick up a link having the same road type with the target link existing on the side of the city center along the minimum-time cost route up to the pertinent and acquires quantities of change of relative speed S of the picked-up link and of the target link (Step S82). Then, the CPU calculates a speed change damping parameter in the target link based on the quantity of change of relative speed $S_{min}$ in the boundary link estimated in Step S81 and the quantity of change of relative speed S acquired in Step S 82 (Step S83).

That is, the CPU fits the quantity of change of relative speed $S_{min}$ in the boundary link estimated in Step S81 and the quantity of change of relative speed S of the target link and the link on the city center side acquired in Step S82 into an approximate expression (represented by a linear expression, a quadratic expression, a polynomial expression, an exponential expression or the like) representing the damping curve of the quantity of change of relative speed S in FIG. 4 to decide a parameter characterizing the approximate expression of the damping curve (this parameter is called as a speed change damping parameter or simply as a damping parameter in the present specification).

More specifically, when the damping curve of the quantity of change of relative speed S is represented by a quadratic function of a distance x from the city center for example, i.e., when the damping curve is expressed as $S(x)=a\cdot x^2+b\cdot x+c$, the parameters a, b and c defining that quadratic curve correspond to the damping parameters. These parameters a, b and c can be calculated based on data ($x_i$, $S_i$), e.g., data represented by points plotted by marks (x) in FIG. 4, of a set of the distance $x_i$ from the city center and the quantity of change of relative speed $S_i$ of a link i (including a boundary link) already found at that time by using a least-square method for example.

It is then possible to calculate the quantity of change of relative speed S of the target link corresponding to the distance from the city center in accordance with the damping curve S(x) when the damping curve S(x), i.e., the parameters a, b and c of the damping curve, is once defined as described above.

It is noted that the estimation of the speed change damping parameter in Step S67 in FIG. 9 may be also carried by the process similar to that in FIG. 10. Their difference is that because there exists no quantity of change of relative speed S based on observed data of the link if the processes in Step S67, the process in the processing flow in FIG. 10 is carried out by assuming that there exists no quantity of change of relative speed S about the link.

Figure 11:
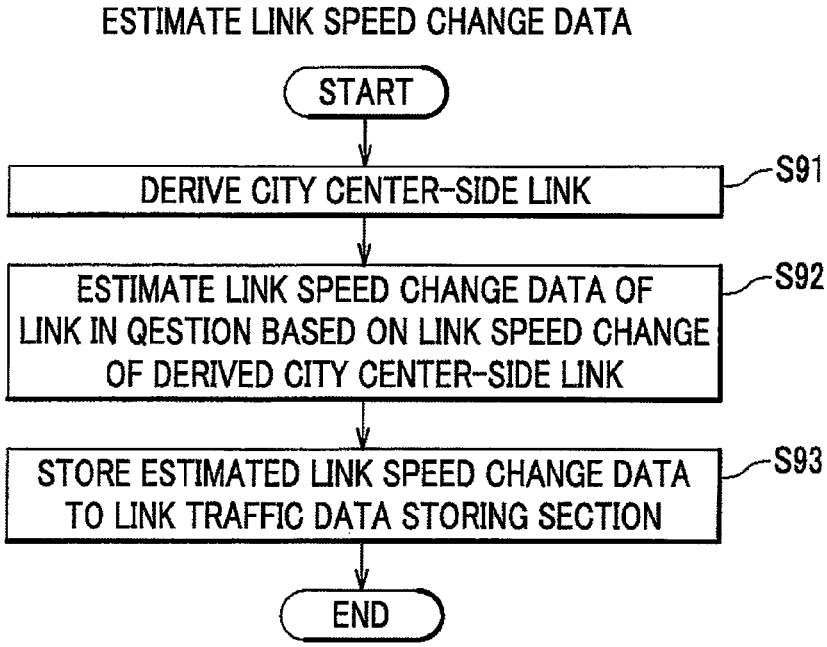
FIG. 11 is a flowchart showing an exemplary detailed processing flow of a link speed change data estimating process in the traffic information estimating process.

FIG. 11 is a flowchart showing an exemplary processing flow of the process (Step S68) for estimating the link speed change data in FIG. 9.

At first, the CPU makes reference to the reference route information storage section 103 to pick up a link existing on the side of the city center along the minimum-time cost route till the target link as shown in FIG. 11 (Step S91). Then, based on the link speed change data of the picked up link existing on the side of the city center, the CPU estimates link speed change data of the target link (Step S92).

The CPU estimates the link speed change data of the target link in accordance with the following procedure in Step S92. When a link having the same road type with the target link is connected on the side of the city center, the CPU estimates the link speed change data v*(t) by using the link speed change data of that link and in accordance with the following Equation 3:

$$v^*(t) = \frac{v^*_{ref} \sum_{k=1}^{L} \frac{v^*_k(t)}{v_{ref_k} \cdot d_k}}{\sum_{k=1}^{L} \frac{1}{d_k}} \quad \text{Eq. 3}$$

In the Equation 3, v*(t) is estimated data of the link speed change data of the target link, $v^*_{ref}$ is reference speed of the target link, $v_k(t)$ is link speed change data of the k-th link that is connected on the city center side along the minimum-time cost distance up to the target link and that has the same road type with the link, $v_{ref_k}$ is reference speed of the k-th link, $d_k$ is a distance (straight distance) between the target link and the k-th link, L is a number of links that are connected on the city center side along the minimum-time cost route up to the target link and that have the same road type with the target link.

When a link whose road type is different from that of the target link is connected on the city center side of the target link on the other hand, the CPU determines whether or not the speed change similarity ratio with respect to the target link is stored by making reference to the speed change similarity ratio storage section 104. When the speed change similarity ratio for the target link is stored as the result of the determination, the CPU sets its value as R*. When no speed change similarity ratio for the target link is stored, the CPU estimates the speed change similarity ratio R* in accordance with Equation 4, as follows:

$$R^* = \frac{\sum_{k=1}^{P} \frac{r_k}{d_k}}{\sum_{k=1}^{P} \frac{1}{d_k}} \quad \text{Eq. 4}$$

In the Equation 4, R* is estimated information of the speed change similarity ratio of the target link, $r_k$ is the speed change similarity ratio of the k-th link stored in the speed change similarity ratio storage section 104, $d_k$ is a distance (straight distance) between the target link and the k-th link and P is a number of links whose speed change similarity ratio is stored in the speed change similarity ratio storage section 104.

The CPU also applies the Equation 3 to a link whose road type is different from that of the target link and connected on the city center side of the target link along the minimum-time cost route up to the target link to calculate link speed change data $v_o(t)$ of the target link. The link speed change data $v_o(t)$ thus calculated is estimated for the link having the different road type and connected on the city center side of the target link. Accordingly, its value is used for the target link to estimate the link speed change data v*(t) of the target link in accordance with the following Equation 5 by using the speed change similarity ratio R* stored in the speed change similarity ratio storage section 104 or the speed change similarity ratio R* estimated by Equation 4:

$$v^*(t)=R^*\cdot v_0(t) \qquad \text{Eq. 5}$$

Thus, the minimum-time cost route v*(t) has been estimated by the Equation 3 or 5 for the both cases when the link having the same road type with the target link is connected on the city center side of the target link and when the link having the different road type is connected. Then, the CPU stores the estimated link speed v*(t) to the link traffic information storage section 102 (Step S93).

As described above, the traffic information estimating device 10 of the present embodiment is capable of estimating traffic information (link speed change data) of a link having no traffic information even in a road network in which an expressway and arterial roads are mixed based on traffic information of a link having the traffic information (link speed change data).

It is noted that although the types of road have been defined to be the expressway and the arterial roads in the explanation of the embodiment described above, they may be a trunk road and city roads, i.e., the expressway may be a trunk road instead. That is, the types of roads may be a trunk road and city roads, i.e., arterial roads. There may be also three or more types of roads such as an expressway, a trunk road and a city road.

Next, the car navigation device 20 that guides a vehicle by using traffic information including the traffic information estimated as described above will be explained.

As explained by using FIG. 1, the link traffic information composed of the observed data and estimated data is transmitted to the car navigation device 20 via the communication network 30 and others and is stored in the link traffic information storage section 202 thereof. The car navigation device 20 also stores road network data that corresponds to road map data to the road network information storage section 201. Then, the car navigation device 20 calculates a guidance route from own car location to a destination set by the user by the guidance route calculating section 22 by using the link traffic information and road network information and displays the calculated guidance route on the guidance route displaying section 23.

Figure 12:
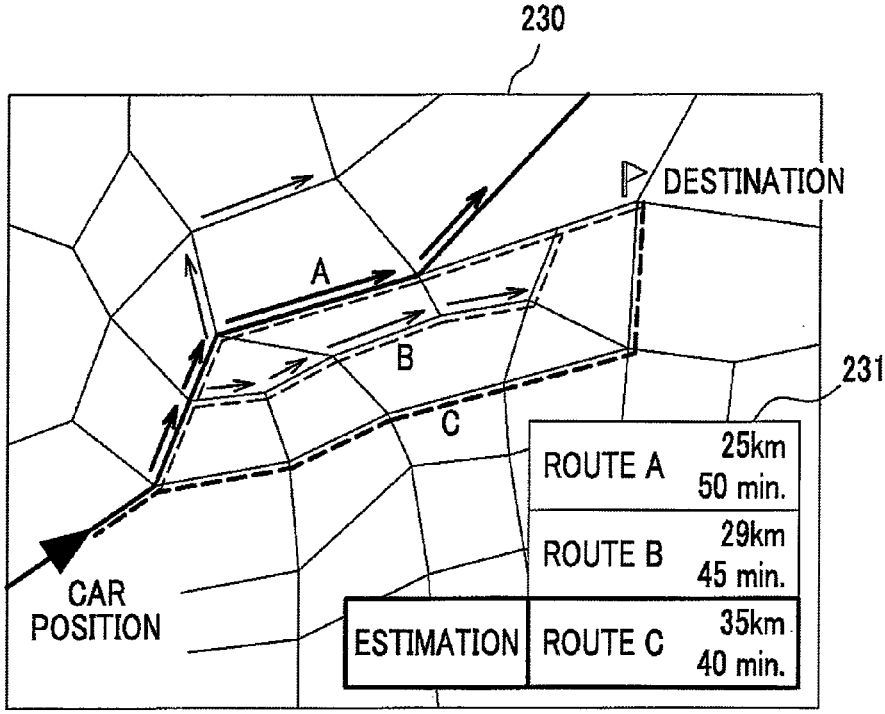
FIG. 12 is a diagram showing an exemplary display screen of the car navigation device displaying guidance routes.

FIG. 12 is a diagram showing an exemplary display screen of the car navigation device 20 displaying guidance routes. The display screen 230 shows roads by solid lines, i.e. shows arterial roads by small solid lines and an expressway by a bold solid line. A black triangular mark denotes own car location and a flag mark denotes the destination. Arrows running beside the roads show that the pertinent roads are congestive while indicating degrees of the congestion by thickness of the lines. While broken lines running beside the roads represent candidate guidance routes, a thick broken line represents recommended route.

The display screen 230 in FIG. 12 also shows a distance and a presumed trip time to the destination of each candidate guidance route as summary information. In case of this example, the presumed trip time of a route A running through the expressway is large even though the distance is short because the expressway is congestive. A route B running in parallel with the expressway is congestive more or less by being influenced by the congestion of the expressway. A presumed trip time of a route C distant from the expressway is least because it is hardly influenced by the congestion of the expressway. Accordingly, the route C is adopted as a recommended route.

Preferably, the route C and the summary information thereof are highlighted by highly visible colors, thick lines, blinking and the like as the recommended route on the display screen 230. The summary information of the route C also indicates as "Estimated". It means that traffic information of a part of links of the route C is not observed data and includes estimated data. It is also preferable to indicate each road (link) represented by the solid line by different display color so as to be able to discreminate roads having observed traffic information from roads having estimated traffic information for example. By displaying as described above, the user can understand a degree of reliability of the guidance route such as a presumed trip time because the user can know a degree of passage of the candidate guidance route passing through roads having estimated traffic information.

Figure 13:
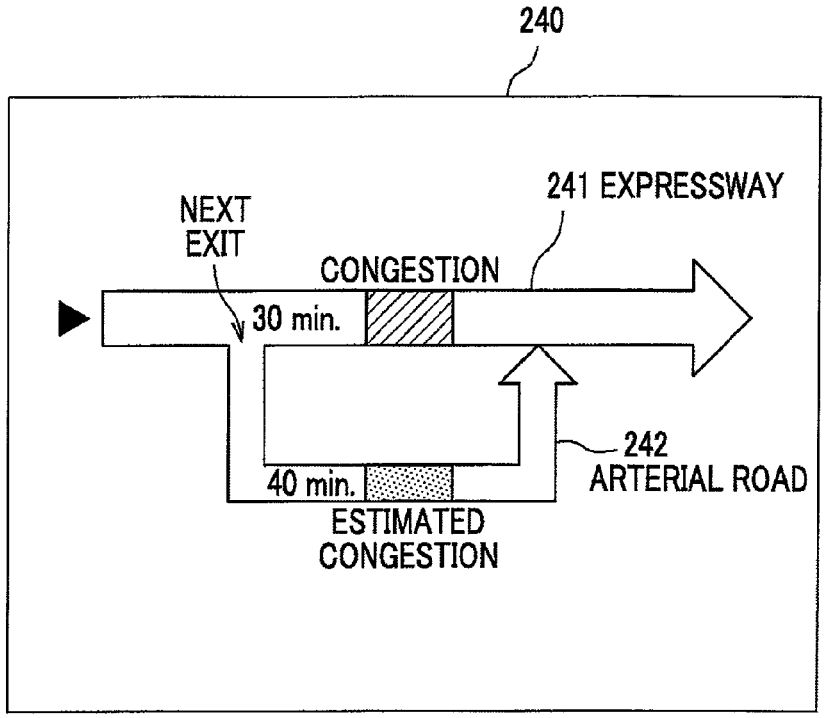
FIG. 13 is a diagram showing an exemplary display screen of the car navigation device displaying congestion information in a guidance route and an alternate guidance route.

FIG. 13 is a diagram showing an exemplary display screen of the car navigation device 20 displaying congestion information of a guidance route and an alternate guidance route. The display screen 240 shows that a congested section exists ahead of the expressway of the traveling guidance route and that therefore, it takes 30 minutes to the destination. The display screen 240 also shows congestion information when the user travels an arterial road from a next exit as an alternate guidance route to avoid the congestion of the expressway. That is, the display screen 240 shows that a congested section is presumed also in the arterial road and a trip time to the destination will be 40 minutes.

Such trip time and the congestion information cannot be displayed also without observed data of the traffic information of the arterial road 242 in general. However, it is possible to display the congestion information, though it is estimated, even if there is no observed traffic information concerning the arterial road 242 in the embodiment.

Next, another embodiment of the invention will be explained with reference to the drawings.

Figure 14:
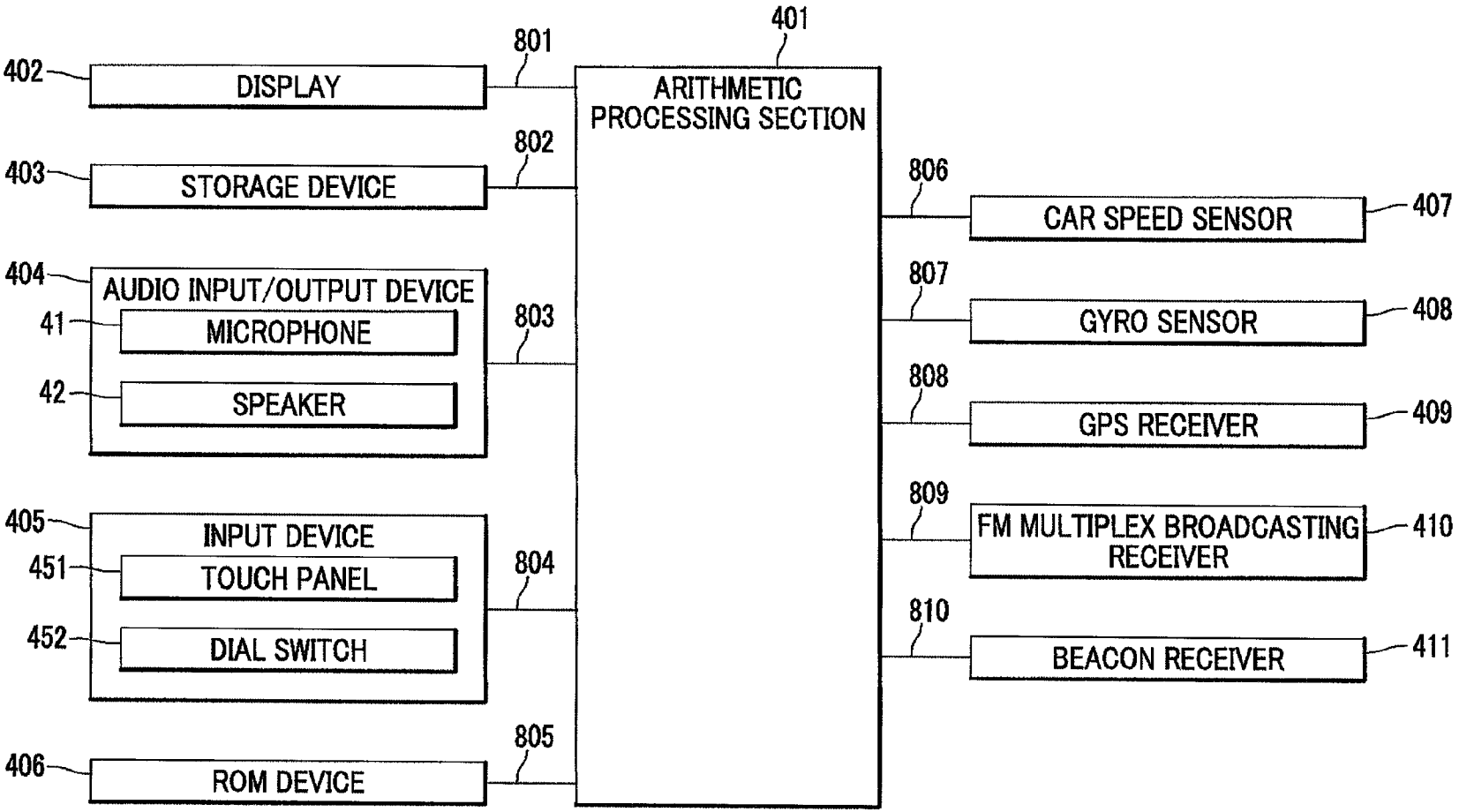
FIG. 14 is a schematic structural view of the car navigation device to which one embodiment of the invention is applied.

FIG. 14 is a schematic structural view of the car navigation device 700 to which the invention is applied. As shown in FIG. 14, the car navigation device 700 has an arithmetic processing section 401, a display 402, a storage device 403, a voice input/output device 404, an input device 405, a ROM device 406, a car speed sensor 407, a gyro sensor 408, a GPS (Global Positioning System) receiver 409, a FM multiplexed boardcasting receiver 410 and a beacon receiver 411.

The arithmetic processing section 401 is a central unit that performs various processing. For instance, it detects a present location based on information outputted out of the various sensors 407 and 408, the GPS receiver 409, the FM multiplexed boardcasting receiver 410 or the beacon receiver 411. The arithmetic processing section 401 also reads map data necessary for its display from the storage device 403 or the ROM device 406 based on the acquired present location information. The arithmetic processing section 401 also develops the read map data as a graphic and displays it on the display 402 by superimposing a mark indicating the present location thereon. The arithmetic processing section 401 also searches an optimum route (recommended route) connecting a starting point (present location) with a destination specified by the user by using the map data and others stored in the storage device 403 or the ROM device 406. It also guides the user by using the voice input/output device 404 and the display 402.

The display 402 is a unit that displays graphic information generated by the arithmetic processing section 401. The display 402 is constructed by using a liquid crystal display, an organic EL display and the like.

The storage device 403 is constructed by a storage medium at least readable/writable such as a HDD (Hard Disk Drive) and a nonvolatile memory card.

A link table 500 and a complementary information table 600, beside the map data necessary for the normal route calculating device, are stored in this storage medium.

Figure 15:
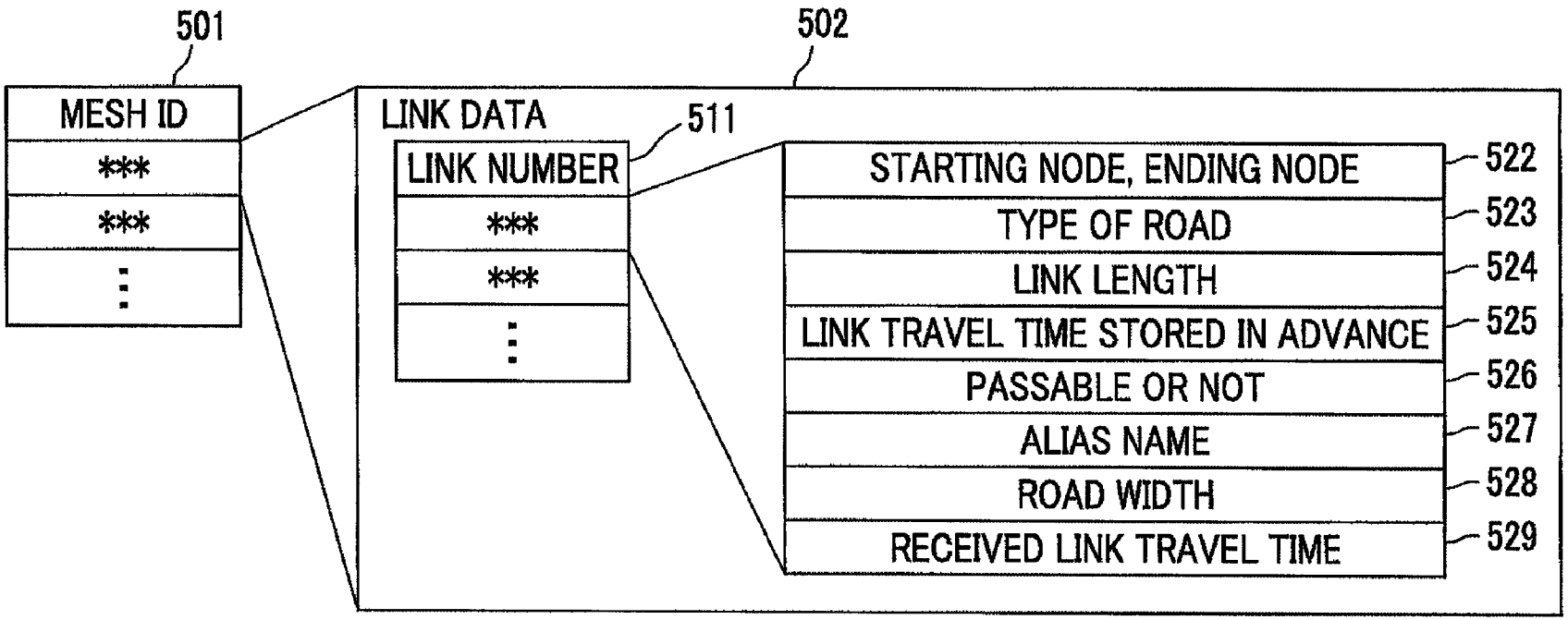
FIG. 15 is a table showing an exemplary configuration of a link table stored in a storage device.

FIG. 15 is a table showing an exemplary configuration of the link table 500. The link table 500 includes link information 502 of each link composing roads included in a mesh area per identification code (mesh ID) of a mesh that is an area parted on the map.

The link information 502 includes, per link ID 511 that is an identifier of the link, coordinate information of two nodes (starting and ending nodes) composing the link, a road type 523 indicating a type of the road including the link, a link length 524 indicating a length of the link, a prelimarily stored link travel time 525, passable or not 526 indicating that whether or not the link is passable, a commonly known name 527, e.g., "the beltway No. 8", of the road including the link, a road width 528 of the road including the link, a received link travel time 529 and so on.

It is noted that up bound and down bound of the same road are controlled as separate links by differentiating the starting and ending nodes of the two nodes composing the link in the embodiment.

The preliminarily stored link travel time 529 is a link travel time held by the navigation device in advance. Meanwhile, the received link travel time 529 is the link travel time received from the outside such as a traffic information provider and sequentially stored.

It is noted that the preliminarily stored link travel time 525 and the received link travel time 529 may be a link travel time correlated with conditions such as time and date, weather and others.

The received link travel time 529 may be a travel time based on statistical traffic information generated as a statistical processing result of information collected since the past.

FIG. 16 is a table showing an exemplary configuration of the complementary information table 600. The complementary information table 600 is a table for storing complementary information used in complementing a link to be complemented (referred to also as a "complement object link" hereinafter). The complementary information table 600 includes information, per ID 601 of the complement object link that is a link to which traffic information is to be complemented, IDs 611 of complement original links, i.e., IDs of links that provide complementary traffic information to the complement object link and average speed 612 indicating an average speed of vehicles passing through the complement original link.

The average speed 612 may be also information of average speed categorized by conditions such as time and date and weather.

In this case, the average speed 612 may be also subdivided into average speed (fair weather), average speed (rainy), average speed (snowy) and the like for example.

The average speed 612 may be also subdivided per time zone into average speed (6 through 8 o'clock), average speed (8 through 10 o'clock), average speed (10 through 12 o'clock), average speed (12 through 14 o'clock) and the like for example.

It is noted that the complementary information table 600 is generated by a complementing section 707 in a traffic information complementing process described later.

This explanation will be continued by returning to FIG. 14. The voice input/output device 404 includes a microphone 441 as a voice input device and a speaker 442 as a voice output device. The microphone 441 catches voices on the outside of the car navigation device 700 such as voices of the user and other passengers.

The speaker 442 outputs messages generated by the arithmetic processing section 401 as voice signals to the user. The microphone 441 and the speaker 442 are provided separately at predetermined regions of the vehicle. However, they may be also stored in one casing. The car navigation device 700 may include pluralities of microphones 441 and speakers 442, respectively.

The input device 405 is a unit for receiving instructions from the user through manipulation made by the user. The input device 405 is composed of a touch panel 451 and a dial switch 452 as well as a scroll key and a scale key that are other hard switches (not shown).

The touch panel 451 is mounted on a display screen side of the display 402 and allows the user to see through the display screen. The touch panel 451 specifies a touch position corresponding to XY coordinates of the screen displayed on the display 402 and outputs the touch position by transforming into the coordinates. The touch panel 451 is composed of pressure-sensitive or electrostatic input elements and others.

The dial switch 452 is configured so as to be rotatable clockwise or counter-clockwise, generates a pulse signal per predetermined angle of rotation and outputs it to the arithmetic processing section 401. The arithmetic processing section 401 obtains a rotation angle from a number of the pulse signals.

The ROM device 406 is composed of a storage medium that is at least readable such as a ROM (Read Only Memory) like a CD-ROM and a DVD and an IC (Integrated Circuit) card. The storage medium stores video data, voice data and others for example.

The car speed sensor 407, the gyro sensor 408 and the GPS receiver 409 are used to detect a present location (own car location) in the car navigation device 700. The car speed sensor 407 detects running speed of the vehicle by an acceleration sensor and others and transmits it to the arithmetic processing section 401. The gyro sensor 408 is composed of an optical fiber gyro, a vibration gyro and others, detects an angle of rotation of the movable body and transmits it to the arithmetic processing section 401. The GPS receiver 409 measures the present location, advancing speed and an advancing direction of the movable body by receiving signals from GPS satellites to measure a rate of changes of distances among the movable body and the three or more GPS satellites. The GPS receiver transmits such data to the arithmetic processing section 401.

The FM multiplexed boardcasting receiver 410 and the beacon receiver 411 receive general present traffic information, control information, SA/PA (Service Area/Parking Area) information, parking space information, weather information and others transmitted from the FM multiplexed broadcasting station such as VICS (registered mark: Vehicle Information and Communication System) transmitted as FM multiplexed broadcasting signals.

Figure 17:
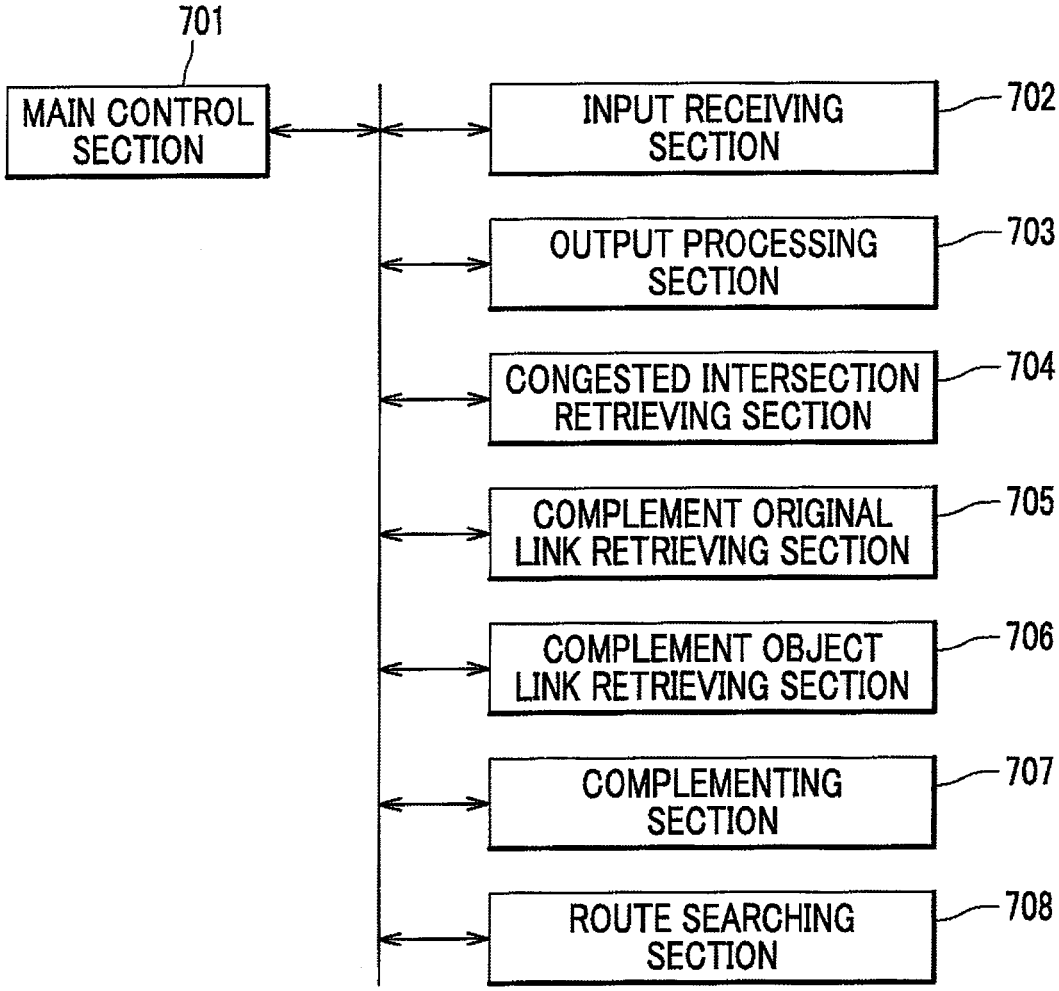
FIG. 17 is a block diagram showing a functional structure of an arithmetic processing section.

FIG. 17 is a block diagram of the arithmetic processing section 401.

As shown in the figure, the arithmetic processing section 401 has a main control section 701, an input accepting section 702, an output processing section 703, a congested intersection retrieving section 704, a complement original link retrieving section 705, a complement object link retrieving section 706, the complementing section 707 described above and a route calculating section 708.

The main control section 701 is a central functional part that performs various processes and controls other processing sections in response to contents of a process. The main control section 701 also carries out navigating processes, e.g., processes of displaying traffic information, displaying a present location, calculating a route, guiding a route and others that are original fundamental operations of the car navigation device 700. The main control section 701 also outputs current time corresponding to a request from each processing section.

The input accepting section 702 is a processing section for receiving an instructive input of the user via the microphone 441, the touch panel 451 and the dial switch 452 and passes it to each processing section.

The output processing section 703 is a functional section for displaying a screen output on the display 402. The output processing section 703 receives screen data in an area required to be displayed and candidates to be displayed on the display 402 and generates screen drawing commands so as to draw roads and other map components as well as a present location, a destination, a recommended route and a dialog for message information by a specified drawing method. Then, it transmits the generated commands to the display 402.

The congested intersection retrieving section 704 derives an intersection node that is an ending node of a link to which traffic information is added and is an ending node of a link to which no traffic information is added and having a predetermined road type among nodes existing within a predetermined area such as one district or prefecture. It then stores the derived intersection node as a congested intersection to the storage device 403.

Specifically, the congested intersection retrieving section 704 derives a node ID of the ending node of the link to which traffic information is added at first. Next, it specifies a link Id of a link whose ending node is a node specified by the node ID of the derived ending node.

Then, the congested intersection retrieving section 704 retrieves a link to which no traffic information is added and having a predetermined road type, e.g., prefectural and national roads, among the links specified by the specified link ID. When there is a corresponding link as a result of the retrieval, the congested intersection retrieving section 704 performs a process for storing that node ID as the congested intersection to an area not shown of the storage device 403.

The complement original link retrieving section 705 performs a process of specifying a link that is an originator of complementation of traffic information.

A point of this process is to track the road to which the traffic information is added among the roads connected to the congested intersection and to specify the tracked road as the originator of complementation to the roads connected to the congested intersection.

Specifically, the complement original link retrieving section 705 carries out processes (705-1) through (705-7) for example, as follows:

(705-1) The complement original link retrieving section 705 acquires the node ID of the congested intersection stored in the storage device 403.

(705-2) The complement original link retrieving section 705 carries out the following processes (705-3) through (705-7) per each node acquired in the process (705-1).

(705-3) The complement original link retrieving section 705 specifies the link ID of the link to which no traffic information is added and that meets predetermined conditions among the links having that node ID as an ending node ID and carries out the following processes (705-4) through (705-7) per each node.

(705-4) When the link specified in the process (705-3) meets the predetermined conditions, the complement original link retrieving section 705 stores it as the complement originating link to a storage area of the storage device 403.

(705-5) The complement original link retrieving section 705 determines whether or not a starting node of the link specified in the process (705-3) is a congested intersection node.

(705-6) When the node is determined to be the congested intersection node as the result of the determination in the process (705-5), the complement original link retrieving section 705 ends the process for the link ID specified in the process (705-3).

(705-7) When the node is determined not to be the congested intersection node as the result of the determination in the process (705-5), the complement original link retrieving section 705 specifies a link having the same node with the starting node of the specified link as its ending node. Then, the complement original link retrieving section 705 carries out the processes (705-4) through (705-7) on that link.

The complement object link retrieving section 706 carries out a process for specifying a link that is an object of complementation of traffic information.

A point of this process is to track a road to which no traffic information is added among roads connected to the congested intersection and to specify the tracked road as the object of complementation.

Specifically, the complement object link retrieving section 706 carries out processes (706-1) through (706-7) for example as follows.

(706-1) The complement object link retrieving section 706 acquires the node ID of the congested intersection stored in the storage device 403.

(706-2) The complement object link retrieving section 706 carries out the following processes (706-3) through (706-7) per each node acquired in the process (706-1).

(706-3) The complement object link retrieving section 706 specifies the link ID of the link to which no traffic information is added and that meets predetermined conditions among the links having that node ID as its ending node ID and carries out the following processes (706-4) through (706-7) per each node.

(706-4) When the link specified in the process (706-3) meets the predetermined conditions, the complement object link retrieving section 706 stores it as the complement object link to a storage area of the storage device 403.

(706-5) The complement object link retrieving section 706 determines whether or not a starting node of the link specified in the process (706-3) is the congested intersection node.

(706-6) When the node is determined to be the congested intersection node as the result of the determination in the process (706-5), the complement object link retrieving section 706 ends the process for the link ID specified in the process (706-3).

(706-7) When the node is determined not to be the congested intersection node as the result of the determination in the process (706-5), the complement object link retrieving section 706 specifies a link having the same node with the starting node of the specified link as its ending node. At this time, the complement object link retrieving section 706 specifies a link having a least angle formed between the both links. Then, the complement object link retrieving section 706 carries out the processes (706-4) through (706-7) for that link.

The complementing section 707 calculates traffic information for each complement object link stored in the storage device 403 by the complement object link retrieving section 706 based on traffic information added to the complement original link and stored in the storage device 403 by the complement original link retrieving section 705. Then, the complementing section 707 complements the calculated traffic information as traffic information of the complement object link.

Specifically, the complementing section 707 specifies the link that originates the complementation for each of the complement object link at first. Then, the complementing section 707 acquires the traffic information added to the link that originates the complementation and calculates traffic information of the complement object link based on the acquired traffic information.

The route calculating section 708 calculates a route connecting two specified points (present location, destination or drop-in point) whose route cost (e.g., a distance and a travel time) is least by using the method of dijkstra. At this time, the route calculating section 708 calculates the cost by adding traffic information. When there is a congested spot for example, the route calculating section 708 calculates such that a travel time of that spot is large as compared to that during normal time.

The route calculating section 708 also calculates the traffic information to be added based on the traffic information calculated by the complementing section 707 in calculating the cost.

Figure 18:
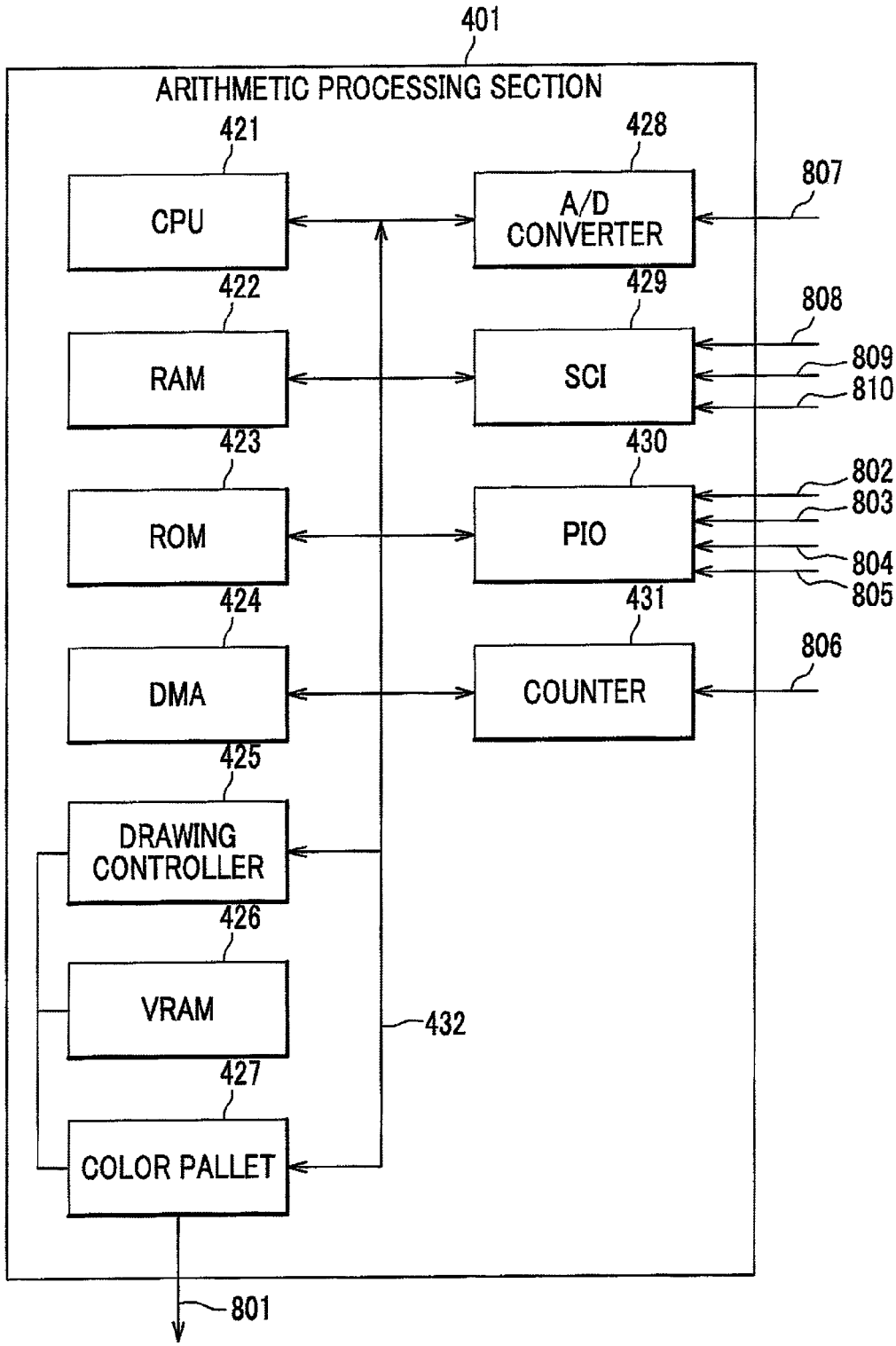
FIG. 18 is a block diagram showing a hardware configuration of the arithmetic processing section.

FIG. 18 is a block diagram showing a hardware configuration of the arithmetic processing section 401.

As shown in FIG. 18, the arithmetic processing section 401 has a structure in which the respective devices are connected through a bus 432. The arithmetic processing section 401 has a CPU (Central Processing Unit) 421 for executing various processes such as numerical operations and control of the respective devices, a RAM (Random Access Memory) 422 for storing map data, arithmetic data and the like read out of the storage device 403, a ROM (Read Only Memory) 423 for storing programs and data, a DMA (Direct Memory Access) 424 for executing data transfer between the memories and between the memory and each device, a drawing controller 425 for drawing graphics and for controlling a display, a VRAM (Video Random Access Memory) 426 for storing graphics image data, a color palette 427 for converting image data into RGB signals, an A/D converter 428 for converting an analog signal into a digital signal, a SCI (Serial Communication Interface) 429 for converting a serial signal into a parallel signal synchronized with the bus, a PIO (Parallel Input/Output) 430 for synchronizing and conveying the parallel signal to the bus and a counter 431 for integrating pulse signals.

It is noted that the respective structural elements and functions described above are achieved by the CPU 421 by executing programs loaded to the RAM 422 and the ROM 423.

[Explanation of Operation] Next, operations of the car navigation device 700 constructed as described above will be explained. It is noted that traffic information is assumed to be a travel time of a link in the present embodiment. That is, it is information about a time that takes to pass through each link. What is used as a basic link travel time is stored in advance in the preliminarily stored link travel time 525 of the link table 500. However, if correction information of a link travel time is stored in a received link travel time 529, the received link travel time 529 will be used.

Figure 19:
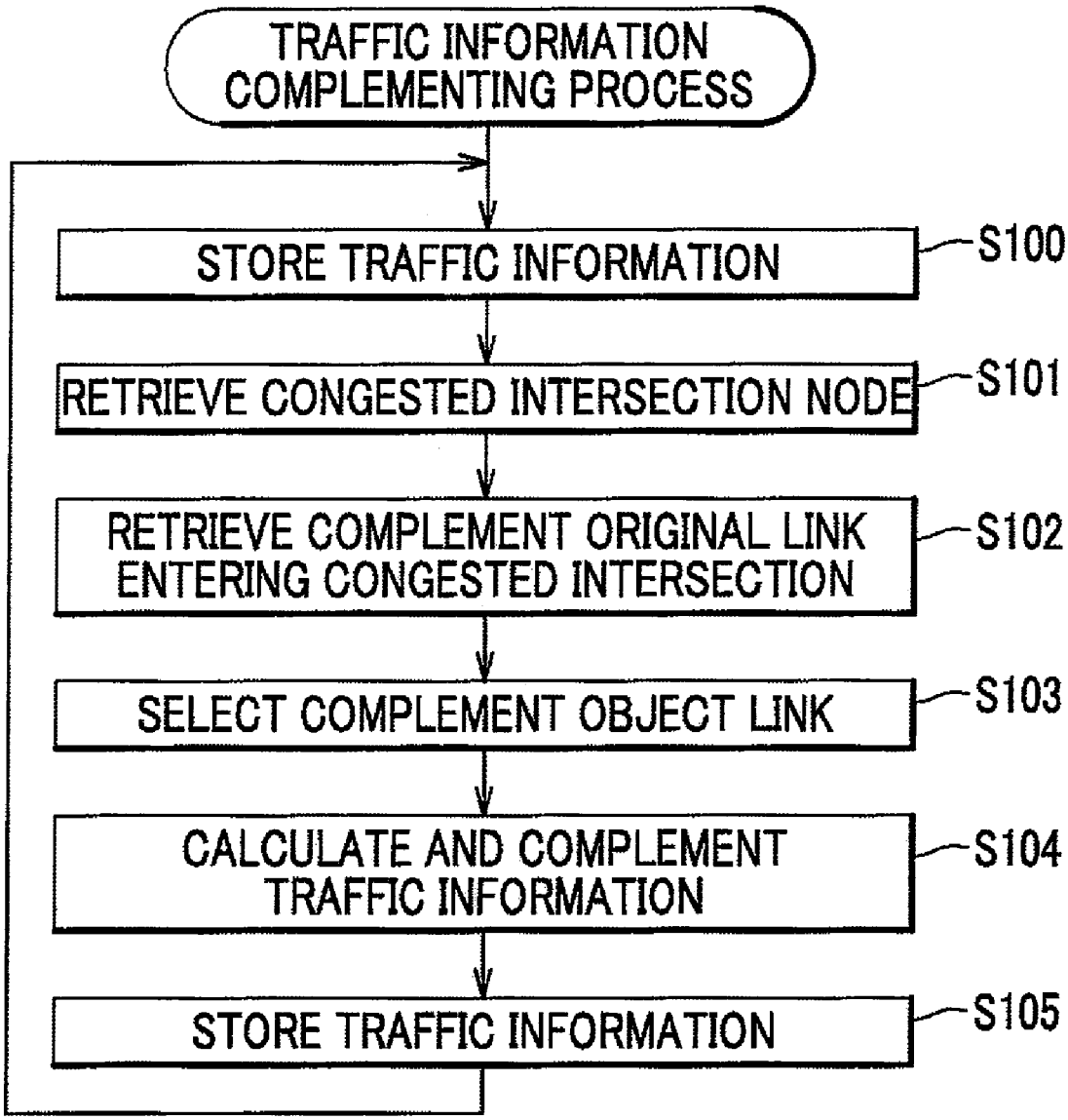
FIG. 19 is a flowchart of a traffic information complementing process.

FIG. 19 is a flowchart of an entire flow of a traffic information complementing process.

The main control section 701 starts this flow when the input accepting section 702 receives an instruction from the user through the touch panel 451, the dial switch 452, the microphone 441 or the like or right after when the car navigation device 700 is turned ON.

The main control section 701 receives traffic information about links within a predetermined range via the FM multiplexed boardcasting receiver 410 or the beacon receiver 411. Then, the main control section 701 specifies a corresponding link from the received traffic information and stores the traffic information to the received link travel time 529 of the link table 500 per every link (Step S100).

Next, the congested intersection retrieving section 704 retrieves a congested intersection node (Step S101).

Specifically, the congested intersection retrieving section 704 retrieves the link table 500 to specify a link whose information on travel time is stored in the preliminarily stored travel time 525 or in the received link travel time 529 by covering meshes within a predetermined distance from a mesh ID to which a present car location belongs. Then, the congested intersection retrieving section 704 derives a node ID of an ending node stored in the starting and ending nodes 522 of that link.

Next, the congested intersection retrieving section 704 retrieves and specifies a link ID of a link whose ending node is the node specified by the node ID of the derived ending node from the link table 500.

Then, the congested intersection retrieving section 704 retrieves a link whose value is not stored in the preliminarily stored travel time 525 or in the received link travel time 529 and whose predetermined road type (prefectural or national road in the present embodiment) is stored in the road type 523 among the links specified by the specified link IDs.

When a corresponding link exists as a result of the retrieval, the congested intersection retrieving section 704 stores the node ID of the ending node of that link, i.e., the node ID described above, as a congested intersection to the area not shown of the storage device 403.

The congested intersection retrieving section 704 ends Step S101 when it ends to store the node ID of all congested intersections to the storage device 403.

Here, the processing course of Step S101 of the traffic information complementing process will be explained below by using a concrete example.

Figure 20:
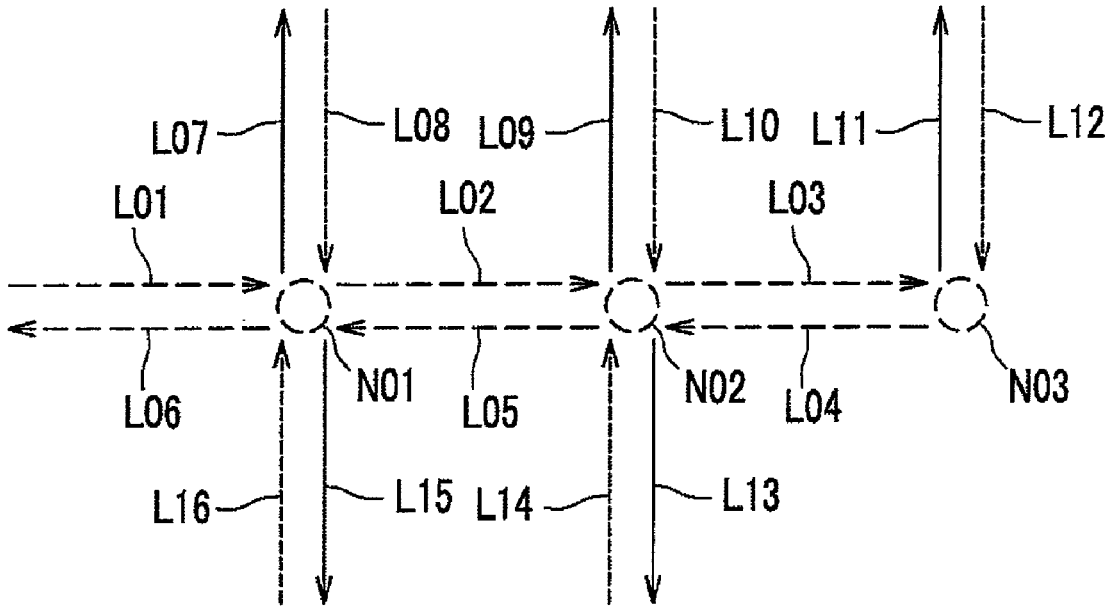
FIG. 20 is a diagram schematically showing an exemplary configuration of nodes and links.

FIG. 20 is a diagram schematically showing an exemplary configuration of nodes and links. Circles in the figure denote the nodes, arrows denote the links and directions of the arrows indicate directions from a starting node to an ending node.

Among the links, broken-line arrows denote links whose value is stored in the received link travel time 529, solid-line arrows denote links whose value is not stored in the received link travel time 529 and dotted-line arrows denote links whose value is not stored in the received link travel time 529 and that enter the nodes.

Here, there are three nodes of nodes N01 through N03 and links directly connecting the nodes are all broken-line arrows, i.e., their values are stored in the received link travel time 529.

Links L01 through L06 are links denoted by the broken-line arrows whose values are stored in the received link travel time 529.

Links L07, L09, L11, L13 and L15 are links having directionalities of going out of the nodes N01 through N03 and links L08, L10, L12, L14 and L16 are links having directionalities of entering the nodes N01 through N03.

It is assumed that the links L01 through L16 are all prefectural roads or national roads.

When the result of the retrieving process of the congested intersection retrieving section 704 is specifically applied here on FIG. 20, links whose value is stored in the preliminarily stored travel time 525 or in the received link travel time 529 are links L01 through L06. Therefore, the nodes N01, N02 and N03 which are their ending nodes are derived.

The links L01 through L05, L08, L10, L12, L14 and L16 correspond to links whose ending nodes are the nodes N01 through N03.

Then, the links L08, L10, L12, L14 and L16 are retrieved when links whose values are not stored in the preliminarily stored travel time 525 nor the received link travel time 529 and whose predetermined road type (prefectural or national road in the present embodiment) is stored are retrieved out of the corresponding links.

Because the nodes N01 through N03 are the nodes of the ending nodes of the links L08, L10, L12, L14 and L16 that corresponded as a result of the retrieval, the congested intersection retrieving section 704 stores the nodes N01 through N03 as the congested intersections in the area not shown of the storage device 403 and ends the process of Step S101.

The processing course of Step S101 of the traffic information complementing process has been specifically explained above.

The complement original link retrieving section 705 retrieves a complement original link that becomes a complement originator among the links connected to the congested intersection in the direction of entering thereto for each of the congested intersections stored in the storage device 403 in Step S101 (Step S102).

Figure 21:
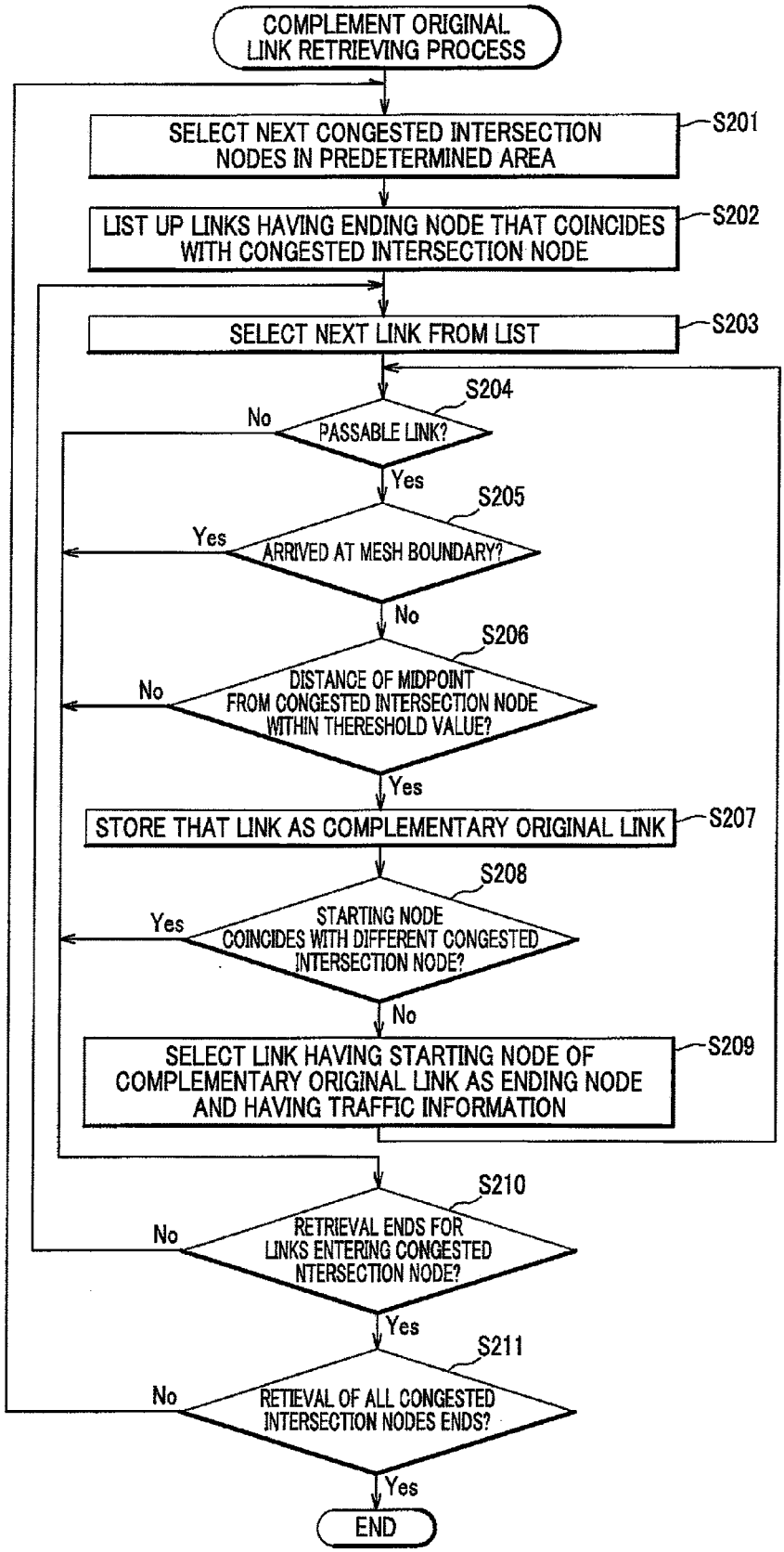
FIG. 21 is a flowchart of a complement original link retrieving process.

This step S102 will be specifically explained by using a flowchart of the complement original link retrieving process shown in FIG. 21.

At first, the complement original link retrieving section 705 acquires a plurality of node IDs of the congested intersections stored in the storage device 403 and selects one out of them as shown in FIG. 21 (Step S201).

Next, the complement original link retrieving section 705 retrieves links that have acquired node IDs as their ending nodes from the link table 500. Out of them, the complement original link retrieving section 705 stores link IDs of links whose travel time information is stored in the preliminarily stored travel time 525 or in the received link travel time 529 and whose predetermined road type (prefectural or national road in the present embodiment) is stored in the road type 523 as a structure in a sequentially accessible structure such as a list structure form for example in the RAM 422 (Step S202).

Then, the complement original link retrieving section 705 selects a next link stored in that structure (Step S203).

Then, the complement original link retrieving section 705 retrieves the link table 500 based on the link ID of the link selected in Step S203 to determine whether a value stored is Yes or No in a step of passable link or not 526 (Step S204). When the result of determination in Step S204 is not Yes (No in Step S204), the complement original link retrieving section 705 shifts the process to Step S210 described below.

If the result of determination in Step S204 is possible (Yes in Step S204), the complement original link retrieving section 705 determines whether or not a starting node of the link selected in Step S203 belongs to another mesh (Step S205). If the result of determination is positive (Yes in Step S205), the complement original link retrieving section 705 shifts the process to Step S210 described below. If the result of determination is negative (No in Step S205), the complement original link retrieving section 705 shifts the process to Step S206 described below.

Next, the complement original link retrieving section 705 calculates a direct distance between coordinates of a midpoint of the link selected in Step S203 and the node of the congested intersection selected in Step S201 to determine whether or not the distance falls within a predetermined threshold value, e.g., 1 km (Step S206).

The complement original link retrieving section 705 calculates the midpoint of the link selected in Step S203 by finding a midpoint of a line connecting the starting and ending nodes of that link.

Or, it is possible to calculate not an actual distance but which number link from the congested intersection to determine whether or not it is a link within a predetermined number of links.

When the distance does not fall within the predetermined threshold value as the result of the determination in Step S206 (No in Step S206), the complement original link retrieving section 705 shifts the process to Step S210 described below.

When the distance falls within the predetermined threshold value as the result of the determination in Step S206 (yes in Step S206), the complement original link retrieving section 705 assumes that the link ID of the link selected in Step S203 as one of the complement original links and stores it into the storage area not shown of the storage device 403 (Step S207).

Specifically, the complement original link retrieving section 705 stores it into the storage device 403 by correlating the node of the congested intersection selected in Step S201 with the link ID of the link selected in Step S203.

Next, the complement original link retrieving section 705 determines whether or not the starting node of the link selected in Step S203 coincides with a node of another congested intersection (Step S208).

Specifically, the complement original link retrieving section 705 retrieves the starting and ending nodes 522 of the link selected in Step S203 to acquire a node ID of the starting node. Then, the complement original link retrieving section 705 determines whether or not the node ID of the acquired starting node exists within the node IDs of the congested intersections stored in the storage device 403 in Step S101.

When the result of the determination is positive (Yes in Step S208), the complement original link retrieving section 705 shifts the process to Step S210 described below.

When the result of the determination in Step S208 is not positive (No in Step S208), the complement original link retrieving section 705 replaces the link whose ending node has the same node ID with the node ID of the starting node of the complement original link and whose information related to travel time is stored in the preliminarily stored travel time 525 or in the received link travel time 529 with the link selected in Step S203 to track the complement original link and repeats the process from Step S204 (Step S209).

The complement original link retrieving section 705 determines whether or not there exists non-selected link among the links stored in the list structure in Step S202 (Step S210).

When there exists a non-selected link as the result of the determination (No in Step S210), the complement original link retrieving section 705 returns the process to Step S203 to carry out the process on and after that.

When there is no non-selected link as the result of the determination in Step S210 (Yes in Step S210), the complement original link retrieving section 705 determines whether or not the processes from Step S201 through Step S210 have been applied to all of the nodes of the congested intersections stored in the storage device 403 (Step S211).

When it is found that there is a node of the congested intersection to which those processes have not been applied as the result of the determination in Step S211 (No in Step S211), the complement original link retrieving section 705 returns the process to Step S201 to carry out the process and thereafter. When it is found that there is no node of the congested intersection to which those processes have not been applied as the result of the determination (Yes in Step S211), the complement original link retrieving section 705 ends the complement original link retrieving process.

Next, the processing course of the complement original link retrieving process will be specifically explained by using FIG. 20.

In Step S201, the complement original link retrieving section 705 acquires the nodes of N01 through N03 because it acquires the node IDs of the congested intersections in the storage device 403. The complement original link retrieving section 705 selects the node N01 as one node among them.

Then, the links L01, L05, L08 and L016 are found when links having the node N01 as their ending node are retrieved in Step S202.

Then, among them, because the links L01 and L05 are the links whose information related to travel time is stored in the preliminarily stored travel time 525 or in the received link travel time 529 and the predetermined road type (prefectural or national road in the present embodiment) is stored in the road type 523, the links L01 and L05 are stored in the RAM 422 in a sequentially accessible structure such as a list structural form for example.

In Step S203, the link L01 is selected among the links stored in that structure.

It is determined whether or not the value of the link L01 stored in the passable or not 526 is Yes in Step S204.

When the result of the determination in Step S204 is Yes, the complement original link retrieving section 705 determines whether or not the starting node of the link L01 belongs to another mesh in Step S205.

When the result of the determination in Step S205 is negative, the complement original link retrieving section 705 shifts the process to Step S206.

In Step S206, the direct distance between the coordinates of the midpoint of the link L01 and the node of the node N01 that is the congested intersection selected in Step S201 is calculated to determine whether or not the distance falls within the predetermined threshold value, e.g., 1 km.

When the distance falls within the predetermined threshold value as the result of the determination in Step S206, the node N01 and the link L01 are stored in the storage device 403 while being correlated from each other in Step S207.

When the starting node of the link L01 is a congested intersection in the determination in Step S208, the complement original link retrieving section 705 advances the process to Step S210.

It is determined in Step S210 that the link L05 remains as a non-selected link. Then, the process is returned to Step S203, the link L05 is selected and the process and thereafter are carried out. That is, the same processes carried out on the link L01 are carried out on the link L05. In case of the link L05 however, it is stored in the storage device 403 by correlating with the node N01 as a result of execution of the process in Step S207.

When the processes on the links L01 and L05 end, the processes are carried out on the remaining nodes N02 and N03 as the result of the determination in Step S210.

The processing course of the complement original link retrieving process has been specifically explained above.

Then, the outline of the traffic information complementing process in FIG. 19 will be explained again.

When the links that become complement originators are retrieved in Step S102, the complement object link retrieving section 706 retrieves complement object link to which traffic information is to be complemented among the links connected in the direction of entering each congested intersection stored in the storage device 403 in Step S101 (Step S103).

This Step S103 will be explained specifically by using a flowchart of a complement object link retrieving process shown in FIG. 22.

Figure 22:
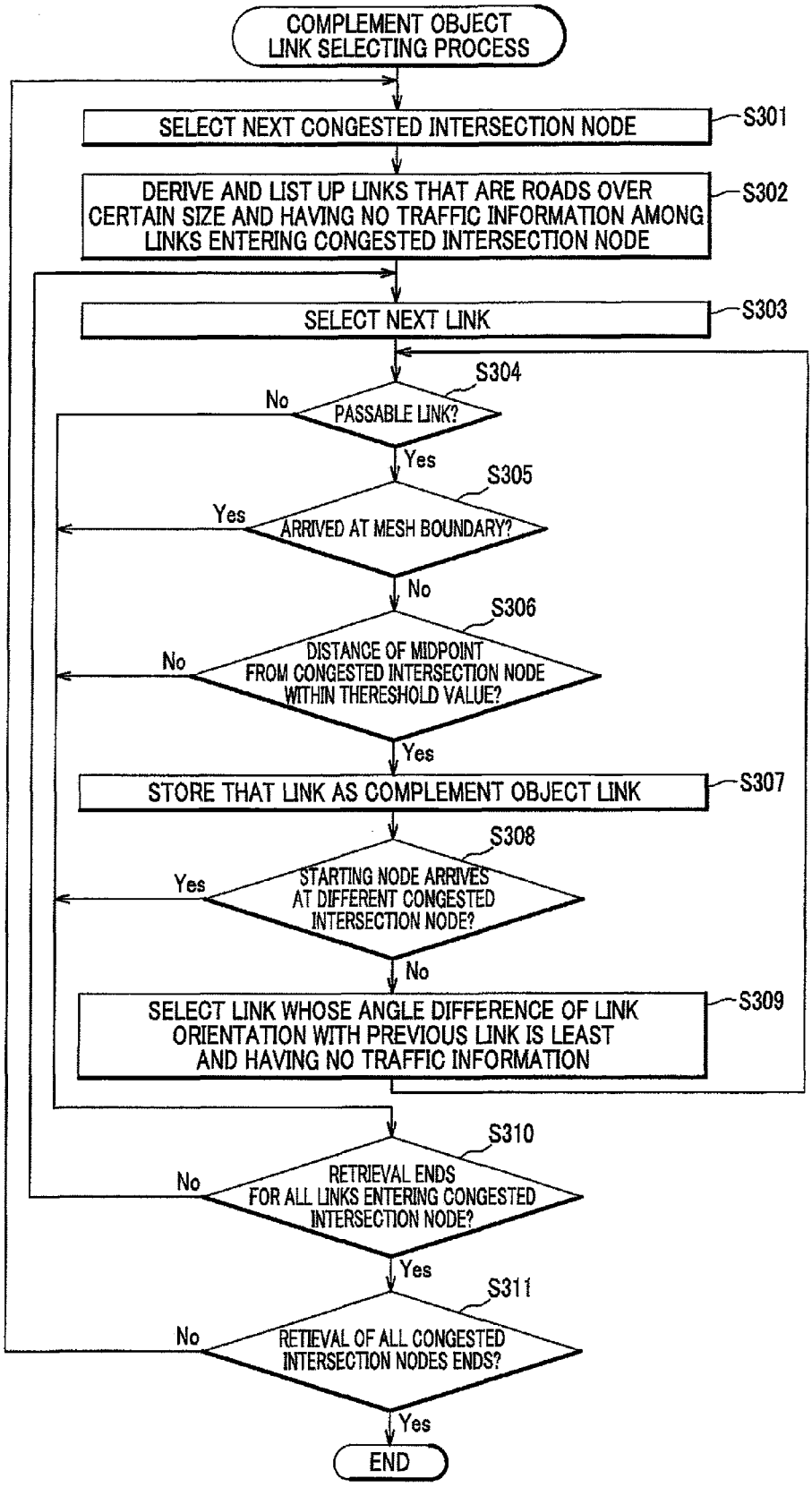
FIG. 22 is a flowchart of a complement object link retrieving process.

At first, the complement object link retrieving section 706 selects one out of node IDs of the congested intersections stored in the storage device 403 as shown in FIG. 22 (Step S301).

Next, the complement object link retrieving section 706 retrieves links that have acquired node IDs as ending nodes from the link table 500. Out of them, the complement object link retrieving section 706 stores link IDs of links whose value is not stored in the received link travel time 529 and whose predetermined road type (prefectural or national road in the present embodiment) is stored in the road type 523 as a sequentially accessible structure such as a list structure form for example (Step S302).

Then, the complement object link retrieving section 706 selects a next non-processed link among the links stored in the structure stored in Step S302 (Step S303).

Then, the complement object link retrieving section 706 retrieves the link table 500 based on the link ID of the link selected in Step S303 to determine whether or not a value stored in the passable or not 526 is Yes (Step S304).

When the result of determination in Step S304 is not Yes (No in Step S304), the complement object link retrieving section 706 shifts the process to Step S310 described below.

If the result of determination in Step S304 is Yes (Yes in Step S304), the complement object link retrieving section 706 determines whether or not a starting node of the link selected in Step S303 belongs to another mesh (Step S305). If the result of determination is positive (Yes in Step S305), the complement object link retrieving section 706 shifts the process to Step S310 described below. If the result of determination is negative (No in Step S305), the complement object link retrieving section 706 shifts the process to Step S306 described below.

Next, the complement object link retrieving section 706 calculates a direct distance between coordinates of a midpoint of the link selected in Step S303 and the node of the congested intersection selected in Step S301 to determine whether or not the distance falls within a predetermined threshold value, e.g., 1 km (Step S306).

The complement object link retrieving section 706 calculates the midpoint of the link selected in Step S303 by finding a midpoint of a line connecting the starting and ending nodes of that link.

Or, it is possible to calculate not an actual distance but what number link from the congested intersection to determine whether or not a link is a link within a predetermined number of links.

When the distance does not fall within the predetermined threshold value as the result of the determination (No in Step S306), the complement object link retrieving section 706 shifts the process to Step S310 described below.

When the distance falls within the predetermined threshold value as the result of the determination in Step S306 (yes in Step S306), the complement object link retrieving section 706 assumes that the link ID of the link selected in Step S303 as one of the complement object links and stores it to the storage area not shown of the storage device 403 (Step S307).

Specifically, the complement object link retrieving section 706 stores the result to the storage device 403 by correlating the node of the congested intersection selected in Step S301 with the link ID of the link selected in Step S303.

Next, the complement object link retrieving section 706 determines whether or not the starting node of the link selected in Step S303 coincides with a node of another congested intersection (Step S308).

Specifically, the complement object link retrieving section 706 retrieves the starting and ending nodes 522 of the link selected in Step S303 to acquire a node ID of the starting node. Then, the complement object link retrieving section 706 determines whether or not the node ID of the acquired starting node exists within the node IDs of the congested intersections stored in the storage device 403 in Step S101.

When a result of the determination is positive (Yes in Step S308), the complement object link retrieving section 706 shifts the process to Step S310 described below.

When a result of the determination in Step S308 is not positive (No in Step S308), the complement object link retrieving section 706 retrieves a link that has the same node ID with the starting node of the link selected in Step S302 as a node ID of an ending node and whose value is not set in the received link travel time 529 to track the complement object link.

Then, when a plurality of links corresponds to that, the complement object link retrieving section 706 calculates a difference of azimuth of the links, i.e., orientation of the links, as an angular difference per each link. Then, the complement object link retrieving section 706 replaces a link whose calculated angular difference is least with the link selected in Step S303 and repeats the processes from Step S304 (Step S309).

Note that the difference of the azimuth of the links will be explained by using FIG. 23.

Figure 23:
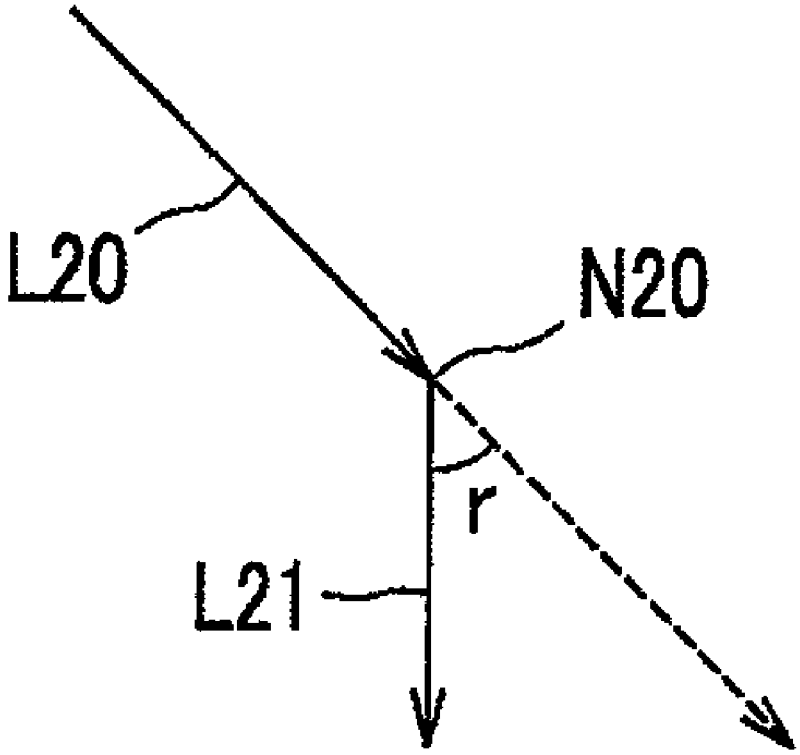
FIG. 23 is a diagram showing a definition of a difference between azimuths of links.

FIG. 23 shows that a link L20 is connected with a link L21 at a node N20. Here, suppose that the link L21 is a link already stored in the storage device 403 as a complement object in Step S307 and the link L20 is one of links retrieved in Step S309.

The difference of azimuth of links is what an inferior angle r formed between the azimuth of the link L20 and the azimuth of the link L21 by a degree measure.

The complement object link retrieving section 706 determines whether or not there exists non-selected link among the links stored in the list structure in Step S303 in Step S310.

When there exists a non-selected link as the result of the determination (No in Step S310), the complement object link retrieving section 706 returns the process to Step S303 to carry out the process on and after that.

When there is no non-selected link as the result of the determination in Step S310 (Yes in Step S310), the complement object link retrieving section 706 determines whether or not the processes from Step S301 through Step S310 have been applied to all of the nodes of the congested intersections stored in the storage device 403 (Step S311).

When there is a node of the congested intersection to which these processes have not been applied as the result of the determination in Step S311 (No in Step S311), the complement object link retrieving section 706 returns the process to Step S301 to carry out the process and thereafter. When it is found that there is no node of the congested intersection to which those processes have not been applied as the result of the determination (Yes in Step S311), the complement object link retrieving section 706 ends the complement object link retrieving process.

Next, the processing course of the complement object link retrieving process will be concretely explained by using FIG. 20.

In Step S301, the complement object link retrieving section 706 acquires the nodes of N01 through N03 because it acquires the node IDs of the congested intersections in the storage device 403.

The complement object link retrieving section 706 selects the node N01 as one node among the nodes of N01 through N03 in Step S302.

Then, the links L01, L05, L08 and L016 are found when links having the node N01 as their ending node are retrieved.

Among the links described above, because the links L08 and L16 are the links whose value is not stored in the received link travel time 529 and the predetermined road type (prefectural or national road in the present embodiment) is stored in the road type 523, the links L08 and L16 are stored in a sequentially accessible structure of a list structural form for example.

In Step S303, the link L08 is selected among those links.

It is determined whether or not the value of the link L08 stored in the passable or not 526 is Yes in Step S304.

When the result of the determination in Step S304 is Yes, the complement object link retrieving section 706 determines whether or not the starting node of the link L08 belongs to another mesh in Step S305.

When the result of the determination in Step S305 is negative, the complement object link retrieving section 706 shifts the process to Step S306.

In Step S306, the direct distance between the coordinates of the midpoint of the link L08 and the node of the node N01 that is the congested intersection selected in Step S301 is calculated to determine whether or not the distance falls within the predetermined threshold value, e.g., 1 km.

When the distance falls within the predetermined threshold value as the result of the determination in Step S306, the node N01 and the link L08 are stored in the storage device 403 while being correlated from each other in Step S307.

When the starting node of the link L08 is a congested intersection in the determination in Step S308, the complement object link retrieving section 706 advances the process to Step S310.

Because the non-selected link is the link L16, the process is return to Step S303 to carry out the process and thereafter in Step S310. That is, the substantially same processes are carried out on the link L16. In case of the link L16 however, it is stored in the storage device 403 by correlating with the node N01 as a result of execution of the process in Step S307.

When the processes on the links L08 and L16 end, the processes are carried out on the remaining nodes N02 and N03 as the result of the determination in Step S311.

The processing course of the complement object link retrieving process has been specifically explained above.

Then, the outline of the traffic information complementing process in FIG. 19 will be explained again.

When the retrieval of the link that becomes the complement object has been carried out in Step S103, the complementing section 707 then acquires information from the complement original link stored in the storage device 403 in Step S102 to complement traffic information for each of the complement object links stored in the storage device 403 in Step S103 (Step S104).

Specifically, the complementing section 707 stores all of link IDs of the complement object links stored in the storage device 403 to a complement object link ID 601 of a complementary information table 600. Then, the complementing section 707 acquires the node IDs of the congested intersections stored in the storage device 403 by correlating with the complement object link ID in Step S307 and acquires all of link IDs of the complement original links correlated with the node ID of that congested intersection in Step S207.

Then, the complementing section 707 stores the link IDs of the complement original links corresponding to the acquired complement object link IDs to a complement original link ID 611 of complement original links 1 through N (N: natural number) of the complementary information table 600 in order from what is close to the congested intersection.

Or, the complementing section 707 may store them to the complement original link ID 611 in order from what having a total travel time from the congested intersection is less.

This process is carried out to all of the complement object links.

Then, the complementing section 707 acquires the received link travel time 529 by making reference to the link table 500 for each of the complement original link ID 611. When the complementing section 707 is unable to acquire an appropriate value, it acquires the preliminarily stored link travel time 525 to calculate speed per minute (unit is m/min.) based on a link length 524. Then, the complementing section 707 stores the calculated speed per minute to an average speed 612 of the complementary information table 600.

Next, the complementing section 707 calculates an average value, i.e., an average value of the speed per minute, of the total of the average speed 612 of the complement original links 1 through N (N: natural number) per each complement object link (that is, Step S104).

It becomes possible to acquire average speed of the vehicles passing through a link intersecting with the link to be complemented and to find an average value calculated based on the that average value by the processes in Step S104.

Then, the complementing section 707 performs processes of dividing the link length of the link to be complemented by the average value calculated in Step S104 and of rounding a solution to an integer. Then, the complementing section 707 stores the solution to the received link travel time 529 of the link to be complemented (Step S105).

It becomes possible to calculate a travel time of the link to be complemented from the average value calculated in Step S104 and to complement the travel time of the link to be complemented.

Assume that the complementing section 707 erases all of the received link travel time 529 when the car navigation device 700 is turned ON.

Or, the complementing section 707 may erase information that is out of predetermined time, e.g., 72 hours, among information in the received link travel time 529 when the car navigation device 700 is turned ON.

The complementing section 707 erases the information that is out of predetermined time as follows. That is, when the complementing section 707 stores the found solution to the received link travel time 529 in Step S105, it also stores time when a corrected link travel time is stored to the storage device 403 by correlating with the link ID of the link to be complemented. Then, the complementing section 707 retrieves the time when the corrected link travel time is stored and compares it with current time to determine whether or not the predetermined time has passed in erasing the information.

It is also possible to arrange the complementing section 707 so as not to erase the unchanged received link travel time 529 when the car navigation device 700 is turned ON.

The complementing section 707 erases such information as follows. That is, the complementing section 707 stores flag information to the storage device 403 by correlating with a link ID of a link to be complemented in the process of storing the solution found in Step S105 to the received link travel time 529.

The complementing section 707 specifies the flag information by determining whether or not only the average speed calculated by acquiring the value out of the preliminarily stored link travel time 525 in Step S104 is used as the average speed of the complement original link.

Then, the complementing section 707 retrieves the flag information by keying the link ID and determines whether or not the received link travel time 529 should be erased corresponding to the flag information.

Thus, it becomes possible to acquire traffic information of a link to which no traffic information is added from another link connected to the closest intersection by Steps S101 through S105. Thereby, it becomes possible to reflect congested traffic information characteristic to a specific intersection that is presumed to be congested and to complement highly accurate traffic information for roads to which no traffic information is provided.

The other embodiment of the invention has been explained above.

The invention is not limited to the embodiments described above and the embodiments may be modified variously within a scope of the technological thought of the invention.

For example, although the embodiments described above assumes the traffic information as the link travel time, the invention is not limited thereto.

That is, it is possible to arrange so as to find complementary information with respect to a congestion distance by setting a congestion distance acquired from outside information, e.g., VICS received information, as traffic information for example.

Specifically, the average speed 612 of the complementary information table 600 is replaced with a congestion distance 612 and the contents of the processes in Step S105 are changed as follows.

The complementing section 707 stores all of the link IDs of the complement object links stored in the storage device 403 to the complement object link ID 601 of the complementary information table 600. Then, the complementing section 707 acquires the node IDs of the congested intersections stored in the storage device 403 by correlating with the complement object link IDs and acquires all of link IDs of the complement original links correlated with the node IDs of the congested intersections.

Then, the complementing section 707 stores the link IDs of the complement original links corresponding to the acquired complement object link IDs to the complement original link ID 611 of the complement original links 1 through N (N: natural number) in order from what is closer to the congested intersection.

Or, the complementing section 707 may store them to the complement original link ID 611 in order from that whose total travel time from the congested intersection is less.

This process is carried out on all of the complement object links.

Then, the complementing section 707 acquires the congestion distance for the respective ones in the complement original link ID 611 by making reference to the traffic information received from the VICS and stores a ratio of that congestion distance with respect to the link length in the congestion distance 612 of the complementary information table 600.

Next, the complementing section 707 calculates an average value of the total of the congestion distance 612 of the corresponding complement original links 1 through N (N: natural number) per each complement object link (that is, an average value of the ratios of the congestion distance with respect to the link length).

Then, the complementing section 707 performs processes of multiplying the link length of the link to be complemented with the average value calculated in Step S104 and of rounding a solution into an integer. Then, the main control section 701 notifies the user of the congestion distance of the link to be complemented by displaying on the display 402 via the output processing section 703.

It is noted that in this notification, the main control section 701 may display the congestion distance obtained by the complementation by different display color so as to be discernible from information of congestion distance acquired not through the complementation.

Still more, when the vehicle approaches to a link whose congestion distance is longer than a predetermined distance, e.g., 500 m, by more than a predetermined distance, e.g., 1 km, the main control section 701 may notify the user of that the vehicle is approaching to the congestion through the voice input/output device 404.

This modification may be also combined with the embodiments described above.

That is, it is possible to modify so as to calculate both of the congestion distance and the link travel time and to use the link travel time for the calculation of a route while displaying the congestion distance on the screen.

When a destination is set by the user as described below, it is also possible to modify so as to preferentially complement a road entering a congested intersection on a recommended route from the present location to the destination and to calculate another congested intersection by using spare processing time of the arithmetic processing section 401 of the car navigation device 700.

In this case, a flag for preferentially processing a node on the current recommended route is given when the congested intersection retrieving section 704 stores the congested intersection nodes to the storage device 403 to store the node ID in Step S101 of retrieving the congested intersection node.

Then, Steps S104 and S105 performed by the complementing section 707 are modified into the following processing contents.

The complementing section 707 stores all of the link IDs of the complement object links stored in the storage device 403 to the complement object link ID 601 of the complementary information table 600. Then, the complementing section 707 acquires the node ID of the congested intersection stored in the storage device 403 by being correlated with the complement object link ID and acquires a link ID of the complement original link correlated with the node ID of the congested intersection to which the preferential processing flag and to which no processed flag is given among the node IDs of the congested intersections.

When the processed flag is given to the node ID to which the preferential processing flag is given, the complementing section 707 obtains the link ID of the complement original link correlated with the node ID of the congested intersection to which no preferential processing flag is given.

Then, the complementing section 707 stores the link IDs of the complement original links corresponding to the acquired complement object links IDs to the complement original link ID 611 of the complement original links 1 through N (N: natural number) of the complementary information table 600 in order from that whose distance from the congested intersection is close.

The complementing section 707 may store them to the complement original link ID 611 in order from that whose total travel time from the congested intersection is less.

This process is carried out to all of the complement object links.

Then, the complementing section 707 acquires the received link travel time 529 by making reference to the link table 500 for each of the complement original link ID 611 and when it cannot acquire an appropriate value, it acquires the preliminarily stored link travel time 525 to calculate speed per minute (unit is m/min.) based on the link length 524. The complementing section 707 stores the calculated speed per minute to the average speed 612 of the complementary information table 600.

Then, the complementing section 707 calculates an average value of the total of the average speed 612 of the complement original links 1 through N (N: natural number) per each one complement object link.

Then, the complementing section 707 performs processes of dividing the link length of the link to be complemented by the average value calculated in Step S104 and of rounding a solution into an integer. Then, the complementing section 707 stores the solution to the received link travel time 529 of the link to be complemented.

Then, the complementing section 707 gives the processed flag to the node ID of the congested intersection to which the preferential processing flag is given.

It becomes possible to preferentially complement the traffic information of the road entering the congested intersection on the recommended route and to execute again for the other congested intersections by modifying so as to store the node ID by giving the flag of performing the preferential processing if the node is on the current recommended route and by modifying the process of the complementing section 707 as described above when the congested intersection retrieving section 704 stores the congested intersections to the storage device 403. Thereby, it becomes possible to enhance a processing efficiency around the city center where the road condition is complex for example.

The modified embodiments have been explained above.

It is noted that the cases in which the present invention has been applied to the car navigation device in the embodiments described above, the invention may be also applied to navigation devices other than the car navigation device.

What is claimed is:

1. A navigation device, comprising:

an intersection retrieving section for retrieving an intersection connected with a road to which traffic information is added and another road to which no traffic information is added;

a complement originator retrieving section for tracking a road connected to the intersection retrieved by the intersection retrieving section and for which traffic information is added up to a predetermined distance to specify the road within the tracked range as a complement originator of traffic information;

a complement object retrieving section for tracking a road connected to the intersection retrieved by the intersection retrieving section and for which no traffic information is added up to a predetermined distance to specify the road within the tracked range as a complement object of traffic information; and a traffic information complementing section for complementing traffic information to the complement object specified by the complement object retrieving section based on the traffic information added to the complement originator specified by the complement originator retrieving section.

2. The navigation device according to claim 1, wherein the intersection retrieving section retrieves an intersection connected with the road to which the traffic information is added and the other road to which no traffic information is added in such directions that those roads enter the intersection;

the complement originator retrieving section tracks the road that is connected to the intersection retrieved by the intersection retrieving section in the direction of entering the intersection and to which traffic information is added in a direction opposite from the entering direction by a predetermined distance to specify the road in the tracked range as a complement originator of traffic information; and the complement object retrieving section tracks the road that is connected to the intersection retrieved by the intersection retrieving section in the direction of entering the intersection and to which no traffic information is added in a direction opposite from the entering direction by a predetermined distance to specify the road in the tracked range as a complement object of traffic information.

3. The navigation device according to claim 1, wherein the complement object retrieving section tracks the road to which no traffic information is added by the predetermined distance while selecting a road whose connecting angular difference is least in a branch if there is the branch.

4. The navigation device according to claim 2, wherein the traffic information complementing section specifies an intersection connected with the road to be complemented and connected in the direction that the road enters the intersection, acquires an average speed of vehicles traveling through the complement originating road per complement originating road based on traffic information added to the complement originating road that enters the specified intersection, calculates a travel time of the complement object road by using the average value calculated based on the average speed per each complement originating road and complements the calculated travel time to the complement object road.

5. The navigation device according to claim 3, wherein the traffic information complementing section specifies an intersection connected with the road to be complemented and connected in the direction that the road enters the intersection, acquires an average speed of vehicles traveling through the complement originating road per complement originating road based on traffic information added to the complement originating road that enters the specified intersection, calculates a travel time of the complement object road by using the average value calculated based on the average speed per each complement originating road and complements the calculated travel time to the complement object road.

6. A traffic information estimating method of a navigation device, comprising steps of:

retrieving an intersection connected with a road to which traffic information is added and a road to which no traffic information is added;

tracking the road connected to the intersection retrieved in the intersection retrieving step and to which traffic information is added up to a predetermined distance to specify the road within the tracked range as a complement originator of traffic information;

tracking a road connected to the intersection retrieved in the intersection retrieving step and to which no traffic information is added up to a predetermined distance to specify the road within the tracked range as a complement object of traffic information; and complementing traffic information to the complement object specified in the complement object retrieving step based on the traffic information added to the complement originator specified by the complement originator retrieving step.

* * * * *